US005380394A

United States Patent [19]

Shibuya et al.

[11] Patent Number: 5,380,394

[45] Date of Patent: Jan. 10, 1995

[54] IMAGE FORMING APPARATUS

[75] Inventors: Kunihiro Shibuya; Masashi Hiroki; Takashi Hatakeyama; Tadayoshi Ohno, all of Kanagawa, Japan

[73] Assignee: Kabushiki Kaisha Toshiba, Kawasaki, Japan

[21] Appl. No.: 65,030

[22] Filed: May 24, 1993

Related U.S. Application Data

[63] Continuation of Ser. No. 738,257, Jul. 30, 1991, abandoned.

[30] Foreign Application Priority Data

Jul. 30, 1990 [JP] Japan ..... 2-201926

[51] Int. Cl.[6] ..... B41J 2/00

[52] U.S. Cl. ..... 156/540; 156/234; 156/238; 428/913

[58] Field of Search ..... 156/234, 238, 540; 400/120; 428/321.5, 913

[56] References Cited

U.S. PATENT DOCUMENTS

| | | | |
|---|---|---|---|
| 3,615,972 | 10/1971 | Morehouse et al. | 156/79 |
| 4,039,065 | 8/1977 | Seki et al. | 400/120 |
| 4,376,942 | 3/1983 | Toth et al. | 400/120 X |
| 4,495,507 | 1/1985 | Moriguchi et al. | 400/120 X |
| 4,558,963 | 12/1985 | Applegate et al. | 400/120 |
| 4,565,737 | 1/1986 | Nishide | 428/321.5 |
| 4,814,790 | 3/1989 | Nitta | 400/120 X |
| 4,831,387 | 5/1989 | Sakaguchi et al. | 400/120 X |
| 4,906,316 | 3/1990 | Seidl | 400/120 X |
| 5,025,267 | 6/1991 | Schofield et al. | 400/120 X |
| 5,117,241 | 5/1992 | Stephenson | 400/120 X |

FOREIGN PATENT DOCUMENTS

| | | | |
|---|---|---|---|
| 61-286192 | 12/1986 | Japan | 428/321.5 |
| 62-92889 | 4/1987 | Japan | 428/321.5 |

*Primary Examiner*—Mark Osele
*Attorney, Agent, or Firm*—Foley & Lardner

[57] ABSTRACT

An image forming apparatus which includes a platen for transporting a recording medium at a prescribed speed, a ribbon drive for transporting a thermoplastic ink ribbon which has a thermoplastic agent and thermal expansible particles contained in the thermoplastic agent in parallel with the recording medium at a speed slower than the transporting speed of the recording medium and a heater for selectively heating the thermoplastic ink ribbon so as to transfer the thermoplastic agent onto the recording medium.

11 Claims, 21 Drawing Sheets

IMAGE FORMING APPARATUS

This application is a continuation of application Ser. No. 07/738,257 filed Jul. 30, 1991 now abandoned.

FIELD OF THE INVENTION

The present invention relates generally to an image forming apparatus and, more particularly, to a thermographic image forming apparatus.

BACKGROUND OF THE INVENTION

In recent years, image forming apparatuses, such as printers, facsimiles, etc., employing a thermographic image forming system have been widely used. They are free of noise during operation, low in cost, provide easy down-sizing and light weight, have excellent operability and are easy to maintain.

Generally, in a thermographic image forming system, a thermoplastic image forming material having a thermoplastic ink layer (hereinafter referred to as an ink ribbon) provided on a sheet shape carrier melts the ink layer by selectively heating this ink ribbon with a thermal head, etc., transfers the melted ink on a recording medium and records an image corresponding to the heated shape.

Conventional ink ribbons have a problem that print quality drops for a recording medium with a surface that is not smooth. To achieve a satisfactory printing on a recording medium having an uneven surface, an image forming apparatus uses an ink ribbon with thermal expansible particles dispersed in a heat soluble ink layer or in a separately provided ink layer (hereinafter referred to as a micro capsule).

On this image forming apparatus, when the ink ribbon is heated by a thermal head, the ink layer is melted and micro capsules expand. The ink is attached to a recording medium by the expansion pressure of the micro capsules. Thus, a satisfactory printing is performed even on a recording medium having an uneven surface.

However, there were still such unsolved problems as shown below, even with the image forming apparatus described above.

(1) The placing pressure is high. As platen pressure was set at a high level form the viewpoint of thermoplastic image forming efficiency between the ink ribbon and the thermal head, such problems were caused as the revolving load of a drum, which transports a recording medium by winding it round the drum. Down-sizing of a driving motor is difficult, due to jitter resulting from a sliding load, wear of the thermal head, etc.

(2) High rate of ink ribbon consumption. Especially in color printing, ink ribbons in multiple colors are consumed, and turning costs are remarkably high. Furthermore, as a long ink ribbon is used because of large consumption, the take-up diameter of an ink ribbon becomes large.

SUMMARY OF THE INVENTION

It is therefore an object of the present invention to provide an image forming apparatus which is capable of reducing the consumption of ink ribbons and setting the platen pressure at a low level without deteriorating print quality.

In order to achieve the above object, an image forming apparatus according to one aspect of the present invention includes a platen device for transporting a recording medium at a prescribed speed, a ribbon drive for transporting a thermoplastic ink ribbon which has a thermoplastic agent and thermal expansible particles contained in the thermoplastic agent in parallel with the recording medium at a speed slower than the transporting speed of the recording medium and a heater for selectively heating the thermoplastic ink ribbon so as to transfer the thermoplastic agent onto the recording medium.

An image forming apparatus according to another aspect of the present invention includes a platen device for transferring an image on a recording medium by selectively heating a thermoplastic ink ribbon which contains an elongated base, a thermoplastic ink layer provided on the base, thermal expansible particles and a heater for applying heating energy containing a plurality of pulses to the image thermoplastic ink ribbon.

An image forming apparatus according to still another aspect of the present invention includes an image transfer device for transferring an image onto a recording medium by selectively heating a thermoplastic ink ribbon which contains an elongated base, a thermoplastic ink layer formed on the base, thermal expansible particles and a preheater for preheating the thermoplastic ink ribbon before the thermoplastic ink ribbon is heated by the image transfer device.

A thermoplastic ink ribbon according to still another aspect of the present invention includes a ribbon base, a thermoplastic ink layer provided on the base and thermal expansible particles contained in the layer in contact with the base.

A thermoplastic ink ribbon according to still another aspect of the present invention includes a ribbon base, a thermoplastic ink layer containing a predetermined coloring agent which is provided on the base and thermal expansible particles contained in the layer, each having a shell containing a coloring agent with a color the same as the first coloring agent and a thermo expansible agent encapsulated in the shell.

A thermoplastic ink ribbon according to still another aspect of the present invention includes a ribbon base, a thermoplastic ink layer containing a predetermined coloring agent which is provided on the base and thermal expansible particles contained in the layer and containing a material with an expansion starting temperature higher than the softening temperature of the thermoplastic ink layer.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
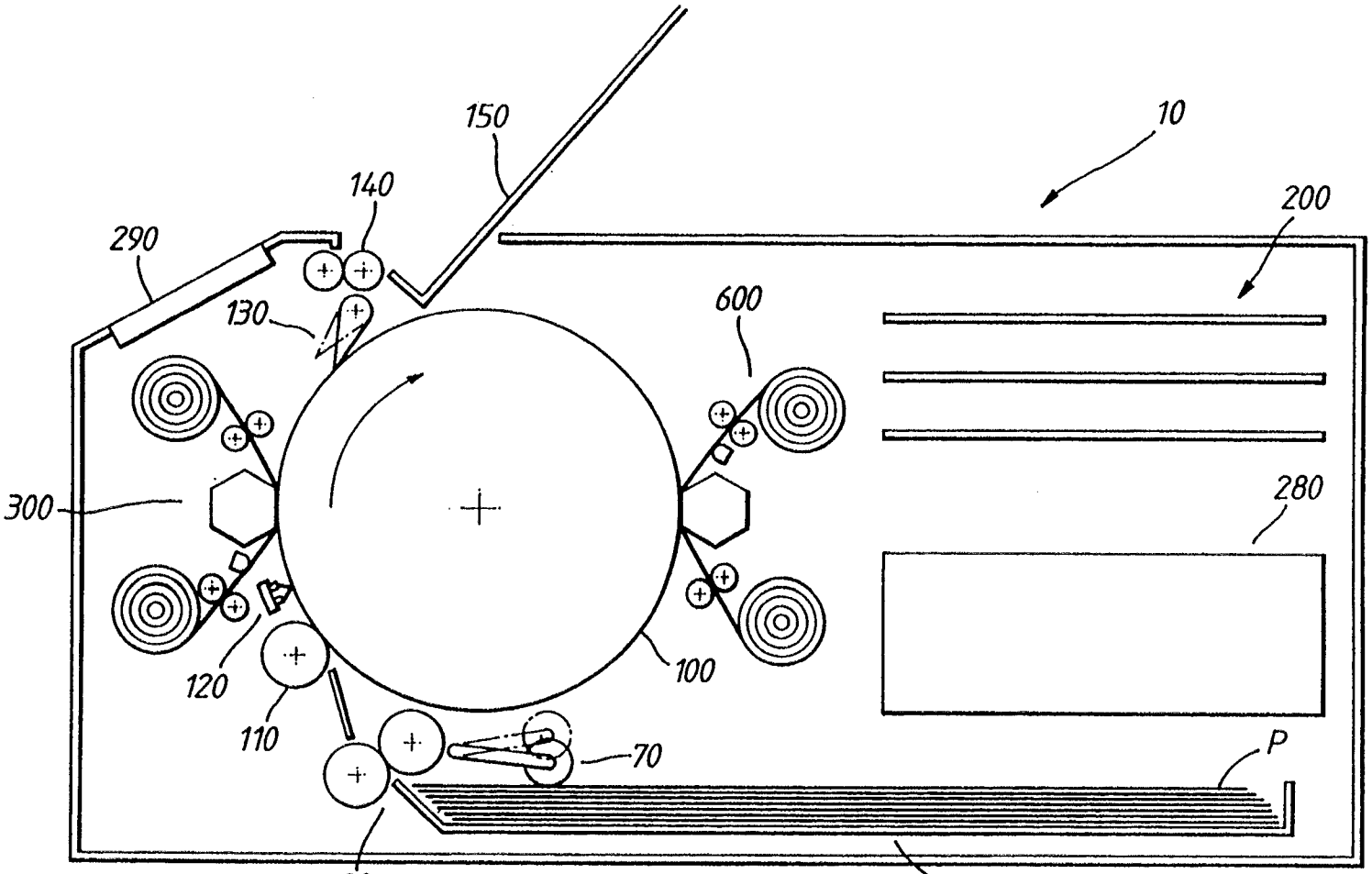
FIG. 1 is a sectional view showing the image forming apparatus 10 according to one embodiment of the present invention.

The present invention will be described in detail with reference to FIGS. 1 through 24. Throughout the drawings, like or equivalent reference numerals or letters will be used to designate like or equivalent elements for simplicity of explanation.

Image Forming Apparatus:

FIG. 1 is a sectional view showing an image forming apparatus 10 according to one embodiment of the present invention. In FIG. 1, a recording paper cassette 60 is equipped for supplying recording papers P.

Further, as the transporting mechanism for recording papers P, a take-out mechanism 70 sends out the recording papers P from the cassette 60; a separating mechanism 90 separates the recording papers P taken out of the cassette 60 and transports the papers one by one; with such dielectrics as PET (Polyethylene Terephthalate), polyimide, etc. formed on the surface. A drum 100 transports the recording paper p by attracting the paper P on its surface, a pinch roller 110 presses the recording paper P against the drum 100, a paper removing claw 130 for strips off the recording paper p from the drum 100 and a paper ejecting mechanism 140 eject the recording papers P onto tray 150.

Further, around the drum 100 are arranged a recording paper sensor 120 for detecting the leading edge and the trailing edge of the recording paper P, a monochrome printing mechanism 900 for performing monochrome printing and a color printing mechanism 600 for performing color printing.

In addition, the image forming apparatus 10 is provided with an interface to receive external image signals, a controlling circuit 200 for controlling the entire apparatus 10, a power supply unit 280 for supplying power to all parts of the apparatus 10 and a control panel 290 for performing various operations with the apparatus 10.

Next, various operations of the image forming apparatus in the construction described above will be explained. The recording papers P are taken out of the recording paper cassette 60 one sheet at a time by the paper take-out mechanism 70 and the paper separating mechanism 90. The paper P is wound round the drum 100 which rotates in the direction shown by the arrow in the drawing by the pressure of the pinch roller 110 against the drum 100.

In case of the monochrome printing, after being printed upon by the monochrome printing mechanism 300, the recording paper is stripped from the drum 100 by the paper removing claw 130 and then discharged on the tray 150 by the ejecting mechanism 140.

On the other hand, in case of the multi-color printing, the paper removing claw 130 is moved by a solenoid, which is not illustrated, to the position shown by the dotted line away from the drum 100. Then, the recording paper P is moved to the color printing mechanism 600 while wound on the drum 100 without being printed by the monochrome printing mechanism 300. In a first printing step, the first color is printed on the paper P. Then, the second and third colors are printed by the color printing mechanism 600 when the drum 100 rotates and after the black is printed by the monochrome printing mechanism 300, the recorded paper P is stripped from the drum 100 by the removing claw 130 and ejected on the tray 150.

Hereinafter, the construction and operation of each part are explained.

Figure 2:
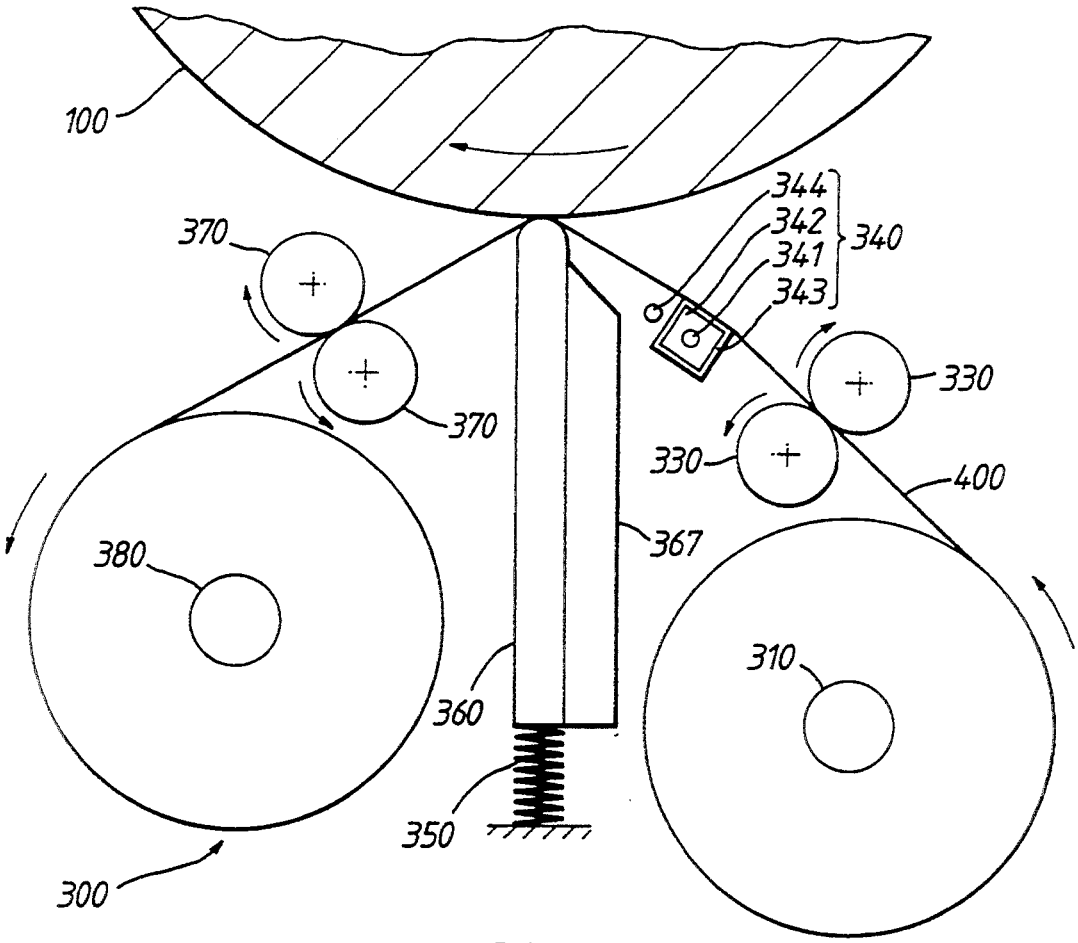
FIG. 2 is a sectional view showing the monochrome printing mechanism.

Monochrome Printing Mechanism:

FIG. 2 is a sectional view of the monochrome printing mechanism 300. The construction of this monochrome printing mechanism 300 will be explained hereinafter.

One end of an ink ribbon 400 is wound on a supply reel 310, clamped between a pair of supply drive rollers 330, 330, kept in contact with a preheater 340, clamped between a thermal head 360 compressed by a compression coil spring 350 on the drum 100 and a pair of take-up drive rollers 370, 370. The other end of the ink ribbon 400 is taken up on a take-up reel 380.

A pair of the supply drive rollers 330 and 330 is directly coupled to and driven by a motor, which is not shown. A pair of the take-up drive rollers 370 and 370 and the take-up reel 380 are driven by way of a sliding clutch, which is not shown.

The transporting speeds of these ink ribbon transporting sections depend on the condition that a peripheral speed of the drum 100>the take-up speed of a pair of the take-up drive rollers 370 and 370, and the transporting speed of the take-up reel 380>the transporting speed of a pair of the supply drive rollers 330 and 330 if the sliding clutch does not slide. A fixed tension is thus given to the ink ribbon 400 by the sliding clutch.

Further, the transporting speed of a pair of the supply drive rollers 330 and 330 which controls the transporting speed of the ink ribbon 400 is set at 0.1 to 0.9 times of the peripheral speed of the drum 100 but it is especially desirable to set it in the range of 0.2 to 0.5 times.

The compression coil spring 350 compresses the thermal head 360 against the drum 100 at less pressure than normal pressure and the pressure as set at 20 to 150 g/cm but it is especially desirable to set in the range of 50 to 100 g/cm.

The preheater 40 has a resistor 341 which is wider than the width of the recording paper P, enclosed and fixed by cement 342 and covered with a teflon sheet 343 having less frictional resistance. The surface temperature of the preheater 340 is controlled to a temperature lower than the melting point of the ink of the ink ribbon 400 by the thermistor 344 mounted on the side contacting the ink ribbon 400 for temperature control.

367 is a driving circuit mount on which a driving circuit of the thermal head 360 is mounted.

Next, the operations of the monochrome printing mechanism 300 will be explained.

Until the recording paper P wound on the drum 100 reaches the thermal head 360, the motor which drives the monochrome printing mechanism 360 is kept stopped and the ink ribbon 400 is pressed against the drum 100 through the paper p in a slipping condition. Then, when this condition is detected by the detecting signal from the recording paper sensor 120 and a delay timer in the controlling circuit 200 that the recording paper P has reached the thermal head 360, the motor starts to in so that the pair of the supply drive rollers 330 and 330, the pair of the take-up drive rollers 370 and 370, and the take-up roller 380 transport the ink ribbon 400 at a speed slower than the peripheral speed of the drum 100.

Further, when it is detected by the detecting signal from the recording paper sensor 120 and the delay timer in the controlling circuit 200 that the recording paper P has passed through the thermal head 360, the motor stops running, so that transportation of the ink ribbon 400 stops.

Transportation of the ink ribbon 400 to such non-image parts as spaces between lines which are not to be printed is tentatively stopped by a control signal from the controlling circuit 200.

After being heated up to a temperature slightly lower than the melting point of the ink of the ink ribbon 400 by the preheater 340 immediately before reaching the thermal head 360, the ink of the ink ribbon 400 is printed on the recording paper P by the thermal head 360. Thus, a satisfactory image can be obtained on the paper P even when the heating energy by the thermal head 360 is less, while a high speed recording is not restricted.

Figure 3:
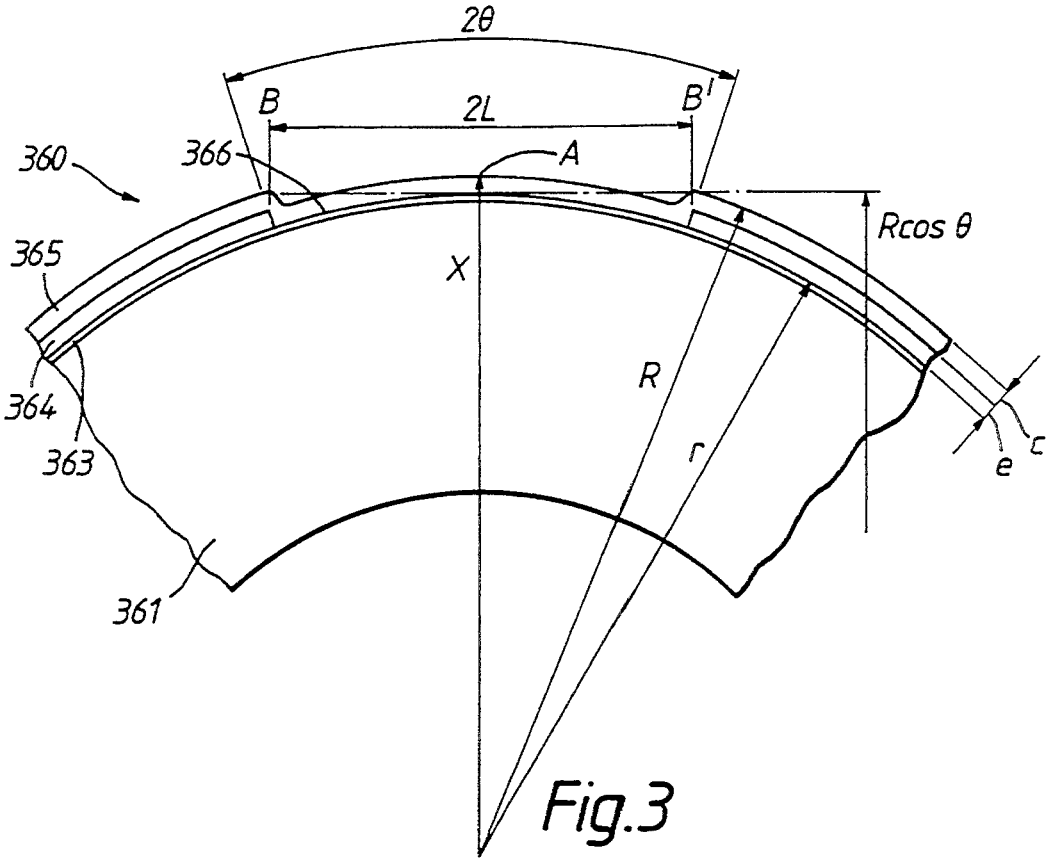
FIG. 3 is a sectional view showing the details of the tip of the thermal head 360.

Thermal Head:

FIG. 3 is a sectional view showing the details of the thermal head 360 which belongs to vertical type thermal heads.

As shown in FIG. 3, after a resistor layer 363 and an electrode 364 have been formed on the surface of a cylindrical glass rod 361 by well-known spattering and etching techniques, a protective layer 365 has been formed over them by such a spattering. A heating resistor 366 having a width represented by "2L" in FIG. 3 has been indented by the thickness "e" of the electrode 364. But, as it has been formed on the cylindrical surface, the surface A of the central part of the heating section is projected against the surface connecting the end surfaces B and B' of the electrode (illustrated by one-dot chain line in FIG. 3). Thus, the section A is securely fitted to the ink ribbon 400 only by contacting the ink ribbon 400 with the tip of the thermal head 360 so that a satisfactory thermoplastic image forming operation can be achieved. To assure this, a radius "r" of the cylindrical surface satisfying the following conditions is needed:

$$X > R \cos\theta$$

where $X=r+e$, $R=r+e+c$, $\theta^{-1}=\sin^{-1}(L/r)$.

Here, by setting $e=3\ \mu m$, $c=7\ \mu m$, $L=65\ \mu m$ (size of the 300 dpi heating resistor 366; $70\ \mu m \times 130\ \mu m$), and also setting $r=0.5$ mm for the values of e, c and L, the following relation is realized:

$$X=507\mu m > R\cos=505.7\ \mu m$$

Figure 4:
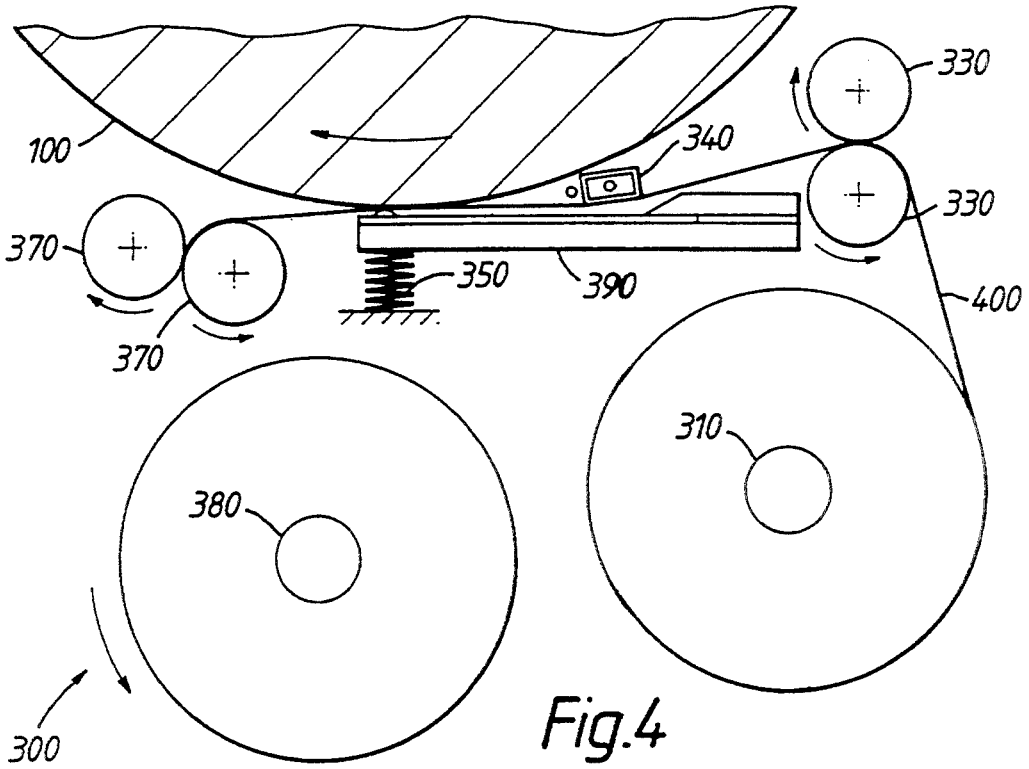
FIG. 4 is a sectional view showing the printing mechanism with a partially glazed thermal head 390.

Further, as a method for closely fitting the ink ribbon 400 to the thermal head 360, a partially glazed thermal head 390 as shown in FIG. 4 may be used in place of the vertical type thermal head as described above.

This type of thermal head 390 is such structure that a glazed glass section forming a part of the cylinder is provided on a ceramic plate. Then the resistor layer 363, the electrode 364, and the protective layer 365 are formed on the surface of the glazed glass section in a similar manner to the thermal head 360 shown in FIG. 3. To closely fit the heating resistor 366 to the ink ribbon 400, the driving circuit mount 367 can be separated from the thermal head 390 by arranging the preheater 340 at the thermal head 390 side from the contacting surface between the heating resistor 366 and the ink ribbon 400.

Figure 5:
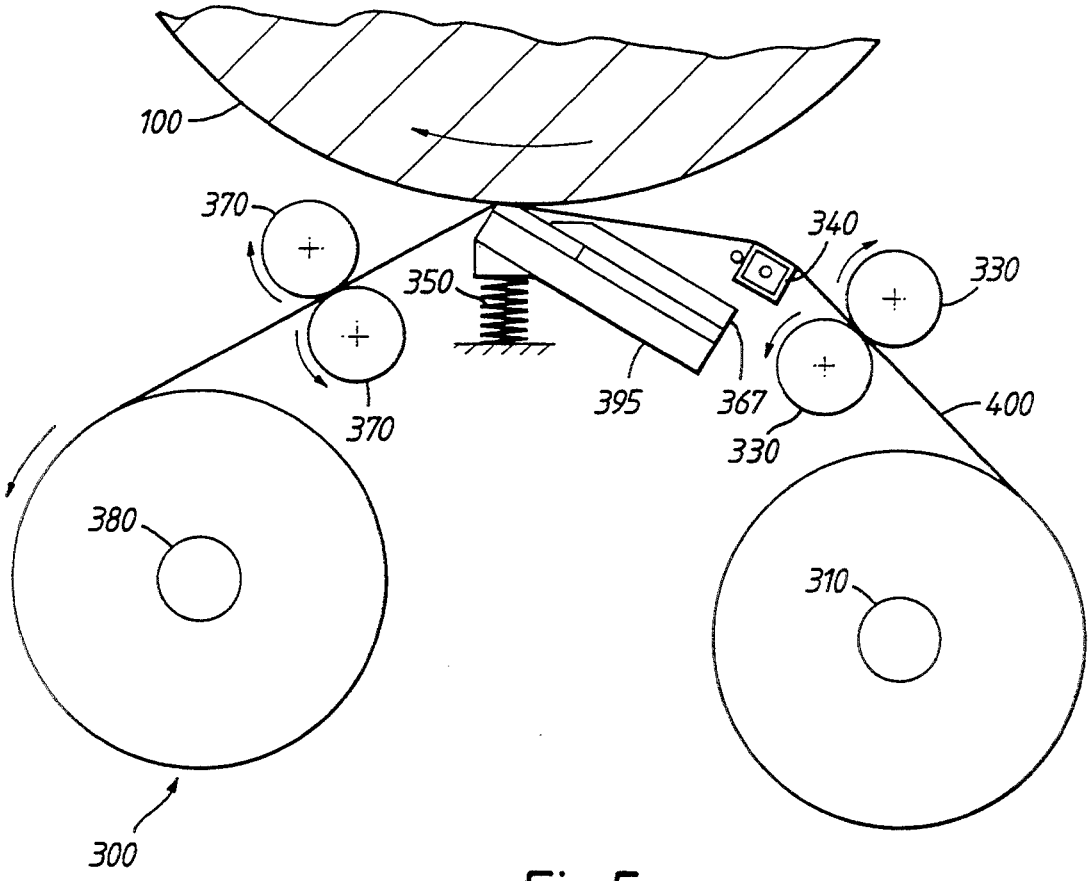
FIG. 5 is a sectional view showing the printing mechanism with a slanting surface type thermal head 395.

Further, as another method for closely fitting the ink ribbon 400 to the thermal head 360, a slanting surface type thermal head 395 as shown in FIG. 5 may be used.

This type of thermal head 395 is in such structure that the corner of the ceramic plate is slanted by 5° to 45° (especially it is preferred to be set in the range of 15° to 35°) to the major plane of the ceramic plate. The heating resistor 366 is formed on this slanting surface. In this case, the ink ribbon 400 can be closely fitted to the heating resistor 366 without being disturbed by the driving circuit mount 367 as illustrated.

Figure 6A:
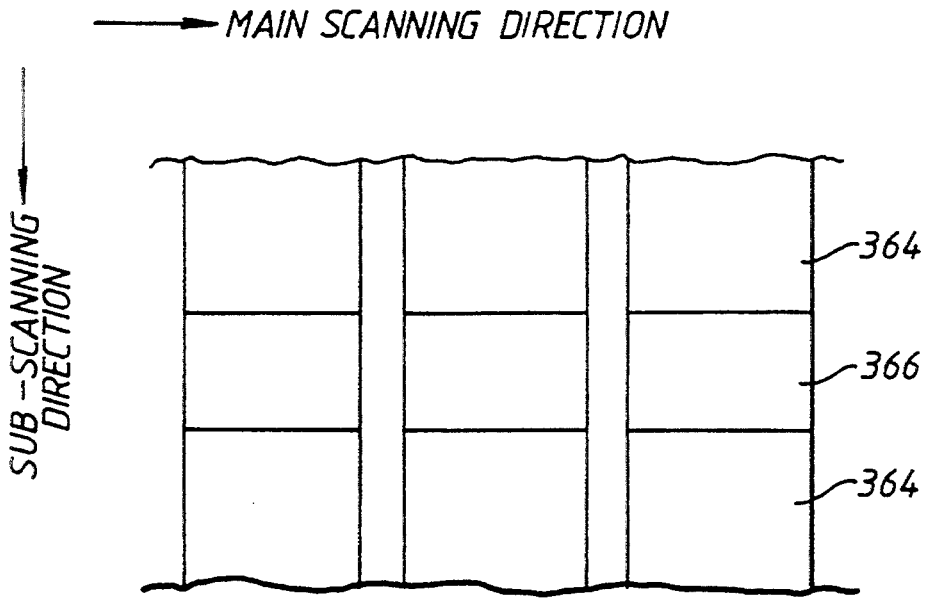
FIGS. 6(*a*) and 6(*b*) are plan views showing two examples of the heating resistor 366 of the thermal head 360.
Figure 6B:
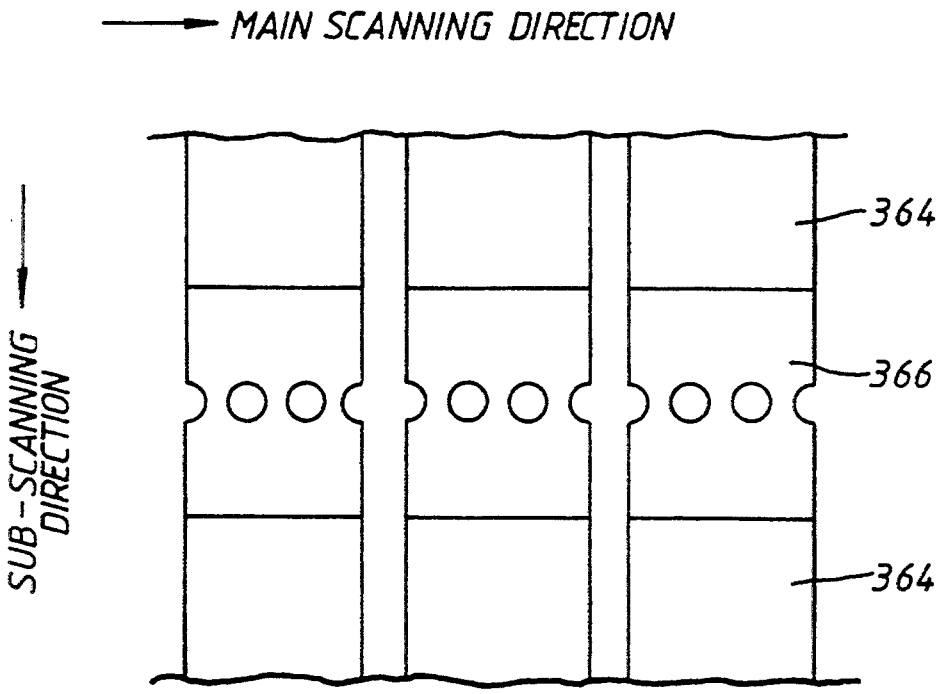
Figure 7A:
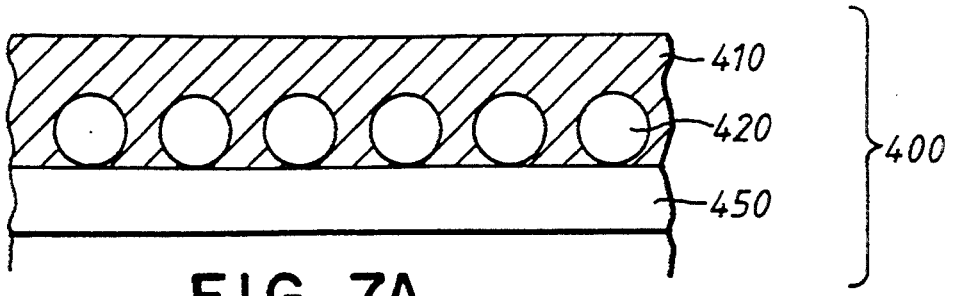
FIGS. 7(*a*) to 7(*d*) are sectional views showing types of ink ribbons 400.
Figure 7B:
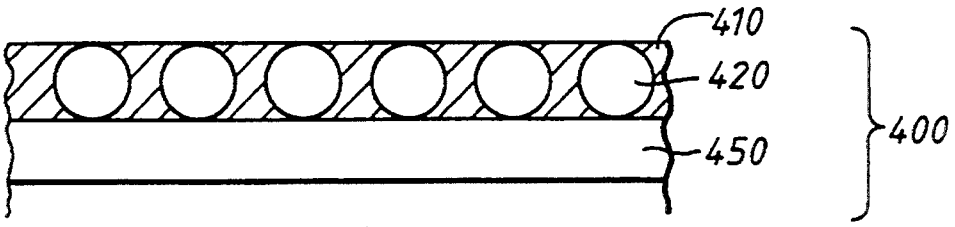
Figure 7C:
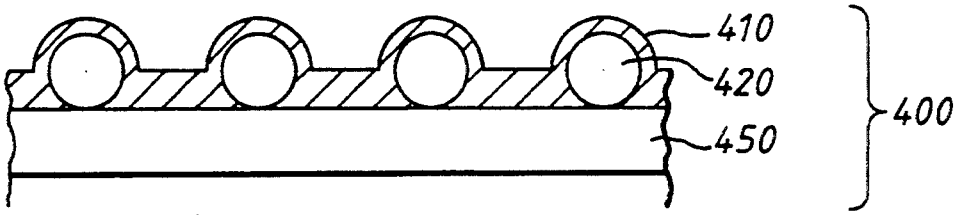
Figure 7D:
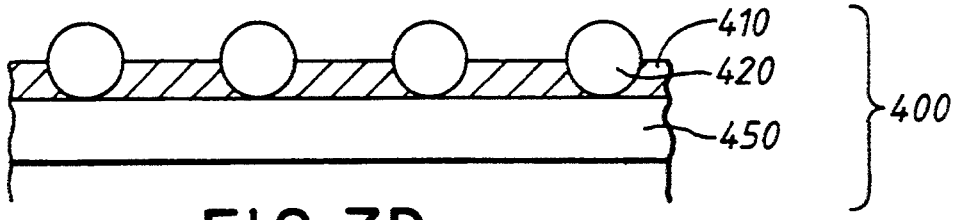

FIGS. 6(*a*) and (*b*) are plan views showing an example of the heating resistor 366 of the thermal head 360, the partial glazed thermal head 390 and the slanting surface type thermal head 395. Shown in the FIG. 6(*a*)

is an example where the length of the heating resistor 366 in the sub-scanning direction is shorter than that in the main scanning direction and it is formed at a ratio of 0.2 to 0.9 times and the especially desirable ratio is 0.5 to 0.8 times.

Further, in FIG. 6(*b*) several portions having no resistor have been provided in the main scanning direction of the heating resistor 366. Thus, current is concentrated in the narrow resistive portions for strongly heating these resistive portions of the heating resistor 366. FIG. 6(*b*) shows the case wherein three heat generating portions are formed on the heating resistor 366. The proper number of the heat generating portions are two to six, and especially two to three is preferred from a manufacturing viewpoint. Further, in addition to the types of heating resistors shown in FIGS. 6(*a*) and 6(*b*), the same effect can be achieved by other types of heating resistors, e.g., the heating resistor disclosed in Japanese Patent Disclosure Tokkai-Sho No. 60-78768.

Ink Ribbon:

Shown in FIGS. 7(*a*)–7(*d*) are sectional views, depicting the details of the ink ribbon 400.

As shown in FIG. 7(*a*)–(*d*), the ink ribbon 400 has a thermoplastic ink layer 410, a plurality of micro capsules 420 and a base film 450. The thermoplastic ink layer 410 is softened and melted by heat. The micro capsules 420 rapidly expand when they are heated. The base film 450 supports the thermoplastic ink layer 410 and the micro capsules 420 thereon. The capsules 420 are dispersed in the thermoplastic ink layer 410 in contact with the base film 450.

As the form of dispersing, the thermoplastic ink layer 410 my be thicker than the diameter of the micro capsule 420 as shown in FIG. 7(*a*). It is also possible to design the ink ribbon 400 so that the diameter of the micro capsules 420 is almost the same as the thickness of the thermoplastic ink layer 410 (FIG. 7(*b*)) or the thermoplastic ink layer 410 is thinner than the diameter of the micro capsule 420 but the projecting portions of the micro capsules 420 being covered with a thin coating of the material of the thermoplastic ink layer 410 (FIG. 7(*c*)), or the diameter of the micro capsule 420 is greater than the thickness of the thermoplastic ink layer 410, only to expose the micro capsules 420 from the thermoplastic ink layer 410 (FIG. 7(*d*)) .

The diameter of the micro capsules 420 is set at 1 to 60 μm (1 to 10 μm) before expansion and 2 to 100 μm (10 to 30 μm) after expansion. The thickness of the thermoplastic ink layer 410 is set at 1 to 10 μm (1 to 10 μm). It is especially preferred to use the thickness values given in parentheses. Further, it is preferred that the micro capsules 420 are dispersed in the thermoplastic ink layer 410 and occupy 1 to 30% in the volume, including the thermoplastic ink layer 410 and the micro capsules 420.

The thermoplastic ink layer 410 contains coloring agents and binders. As the coloring agents, proper pigments such as carbon black, and materials disclosed in the Japanese Patent Disclosure Tokkai-Sho No. 60-25792 such as nigrosine dye, lamp black, or various dyes and coloring agents generally used in the field of printers and copiers are available.

Further, as binders, various materials, as disclosed in Japanese Patent Disclosure Tokkai-Sho No. 59-20894, are available. These include:

Waxes, such as carnauba wax, paraffin, micro crystalline wax, etc., high-class fatty acids, such as palmitic acid, stearic acid, lauric acid, stearic acid aluminum, stearic acid lead, stearic acid barium, stearic acid zinc, palmitic acid zinc, methylhydroxy stearate, glycerolmonohydroxystearate, etc., or their metallic salts and their ester derivatives, thermoplastic resins consisting of individual or copolymer or their derivatives, e.g., oleins consisting of individual or copolymer or their derivatives such as polyethylene, polypropylene, polyisobutylene, polyethylene wax, polyethylene oxide, tetrafluoride polyethylene, ethylene-acrylic acid copolymer, ethylene-acrylic acid ethyl copolymer, olein ethylene-vinyl acetate copolymer, etc.

As other examples, including definite examples, the following materials are available: waxes such as beeswax, candelilla wax, polyethylene wax, enamel, ester wax, wax oxide, montan wax, ozokerite, sericin, etc.; high-class alcohols such as palmimic alcohol, stearic alcohol, behenil alcohol, etc.; high-class fatty acid esters such as palmitic acid ethyl, palmitic acid myricyl, stearic acid ethyl, stearic acid myricyl, etc.; such amides as acetamide, propionic acid amide, palmitic acid amide, and stearic acid amide; such resins as cellulose resin (ethyl cellulose, etc.) terpene resin, polyester resin, rosin resin, epoxy resin, vinyl resin (vinyl acetate resin, vinyl chloride resin, vinyl chloride acetate copolymer, vinyl butyral resin, polystearic acid vinyl, etc.), butadiene resin, aromatic petroleum resin, low molecular weight petroleum resin, ketone resin, styrene resin, fatty acid bicarbonate resin, polyamide resin, polystyrene resin, ester resin, acrylic resin, sulfonic resin, polyethylene glycol, polyacrylic amide, polyvinyl pyrrolidone, ester gum, rosin maleic acid resin, rosin phenol resin, phenol resin, terpene resin, cyclopentadiene resin, aromatic resin, urea resin, silicon resin, etc.; high-class amides such as stearic amide, etc.; high molecular polymers such as styrene-butadiene copolymer, acetate butyrate, etc.; polyvinyl alcohol, etc. These binders may be used individually or in a combination of two or more of them.

Figure 8:
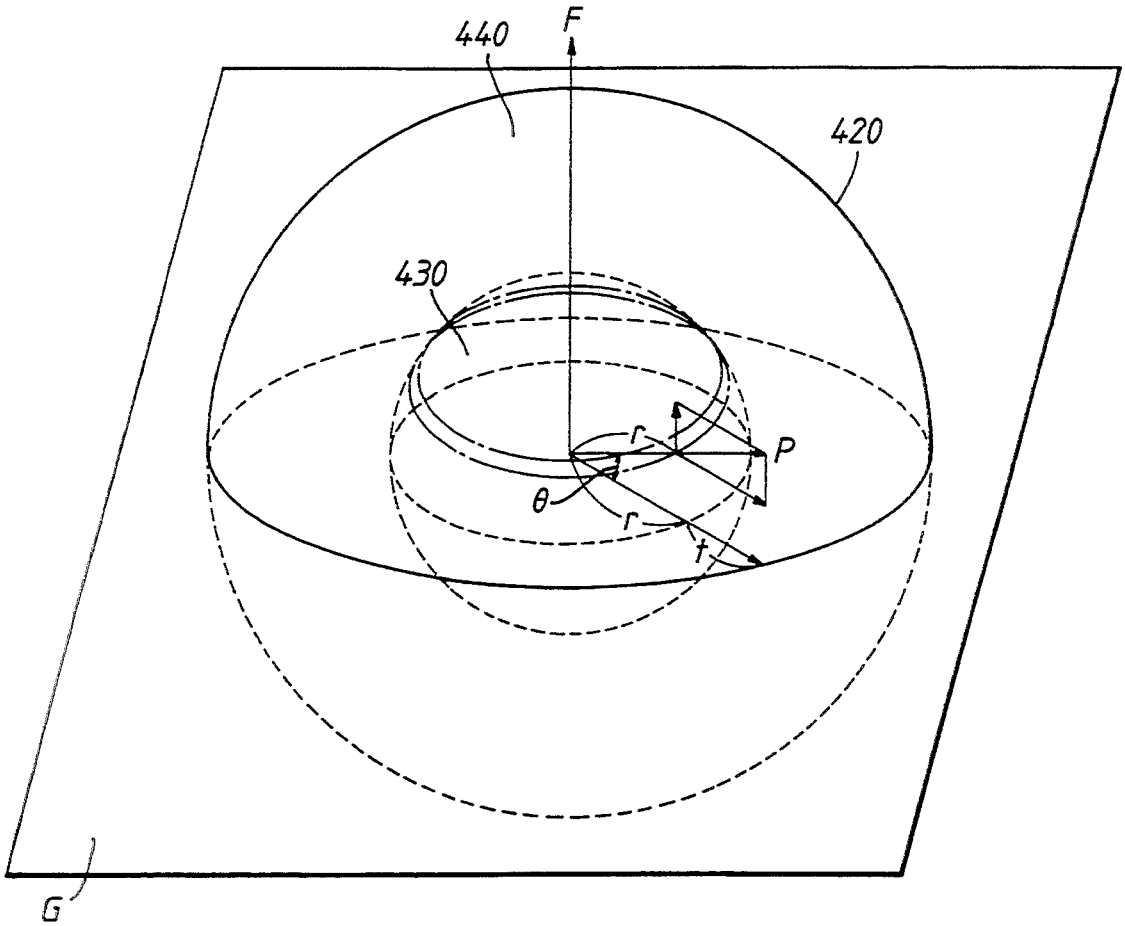
FIG. 8 is an oblique view showing construction of the micro capsule 420 and the status of the micro capsule 420 cut in half by horizontal plane G.

Shown in FIG. 8 is an oblique view showing the details of the micro capsule 420, wherein the micro capsule 420 is cut into two parts by the horizontal plane G for an illustration purpose.

The micro capsule 420 has a heat expansion material 430 and a shell 440 for containing the heat expansion material 430 therein. As the heat expansion material 430, thermal crack blowing agent or volatile liquid with a low boiling point is available.

An expansion starting temperature of the micro capsule 420 containing the heat expansion material 430 is desirable to be higher than a softening temperature of a binder. In particular, a temperature difference between the expansion starting temperature and the softening temperature is preferred to be in the range of 0° C. to 50° C. Since the binder's softening temperature of the thermoplastic ink layer 410 is normally set in the range of 55° C. to 150° C., if the softening temperature of the binder is, for instance, 55° C., a preferred range of the expansion starting temperature of the micro capsule 420 will become 55° C. to 150° C. If the softening temperature of the binder is 150 ° C., a preferred range of the expansion starting temperature of the micro capsule 420 will become 150° C. to 200 ° C.

Further, when restraining the micro capsule 420 from expansion (when a paper in use for "thermoplastic image forming" or a sheet in use for "OHP" (over head projector) was selected by a recording paper selecting key which will be described later) having a good surface smoothness (Bekk's smoothness is 200 sec. or more) by changing the amount of heat applied (applied energy) corresponding to the smoothness of the surface of a recording paper (recording medium) as described later, it is necessary to restrain the micro capsule 420 from expansion even when the ink is melted. It is, therefore, preferred to set to an expansion starting temperature higher than the softening temperature of the binder. In particular, the expansion starting temperature is preferred to be higher than the softening temperature of the binder by 10° C. to 50° C. For instance, when the softening temperature of the binder is 55° C., the preferred range of the expansion starting temperatures of the micro capsule 420 is in the range of 65° C. to 105° C.

For instance, if the softening temperature of the shell 440 is higher than the thermal cracking temperature of the heat expansion material 430 or boiling points of volatile liquids, even when the micro capsule 420 is heated up to the softening temperature of the shell 440, the micro capsule 420 does not expand, because the strength of the shell 440 overcomes the inner pressure of the shell 440.

That is, the expansion of the micro capsule 420 does not depend on a thermal cracking temperature of the blowing agent contained in the heat expansion material 430 or the boiling point of the volatile liquid also contained in the heat expansion material 430, but depends on the softening temperature (strength) of the shell 440. In this case, therefore, the expansion starting temperature of the micro capsule 420 can be set according to material, a blending condition thereof, etc. of the shell 440.

On the other hand, when the softening temperature of the shell 440 is lower than the thermal cracking temperature of the blowing agent contained in the heat expansion material 430 or the boiling point of the volatile liquid, thermal cracking temperature of the blowing agent contained in the heat expansion material 430 or the boiling point of the volatile liquid depends on the expansion of the micro capsule 420. In this case, therefore, the expansion starting temperature can be set, depending on materials of the heat expansion material 430, blending conditions thereof, etc.

Here, conditions for expanding the micro capsule 420 are explained in the case where the softening temperature of the shell 440 is higher than thermal cracking temperature of the blowing agent of the heat expansion material 430 or the boiling point of the volatile liquid.

In FIG. 8, assuming that the inner diameter of the shell 440 is "r", a specific gravity of the heat expansion material 430 contained in the shell 440 is "p", and a molecular weight of the heat expansion material 430 is "M", then the inner pressure "P" is given by the following equation.

$$P = \{(4\pi r^3/3) \times p/M) \times 22.4 \times 10^3/(4\pi r^3/3)$$
$$= 22.4 \times 10^3 \times p/M \ldots$$

Thus, it is seen from the equation that the inner pressure "P" is independent of the shape of the shell 440. So, when assuming that the thickness of the shell 440 is "t" and a vertical force applied to the hemisphere of the shell 440 by the inner pressure "P" is "F", $$F = \int_0^{\pi/2} P \sin\Theta \times 2\pi r \cos\Theta \times r d\Theta$$
$$= \pi r^2 P$$

When assuming that elastic limiting stress is F, atmospheric pressure is Po, the conditions for the shell 440 to expand are, $$F - \pi(r+t)^2 Po > \pi\{(r+t)^2 \text{to } r^2)\delta = \pi(2r+t)t\delta$$

that is, $$P > \}(r+t)^2 Po + (2r+t)t\delta\}/r^2$$

Therefore, under the condition where the shell 440 is softening by a temperature rise and the elastic limiting stress "δ" drops, the micro capsule 420 having the larger inner diameter "r" expands easily and the micro capsule 420 having the thinner film thickness expands easily.

Further, in the latter case, that is, when the softening temperature of the shell 440 is lower than the thermal cracking temperature of the blowing agent of the heat expansion material 430 or the boiling point of the volatile liquid, the inner pressure "P" in the following equation changes largely and similar to the former case, the micro capsule 420 having the larger inner diameter "r" expands easily and that having the thinner film thickness "t" expands easily:

$$P > \}(r+t)^2 Po + (2r+t)t\delta\}/r^2$$

The expanding conditions of the micro capsule 420 described above are further explained in reference to FIGS. 9(*a*) to 9(*c*).

Figure 9A:
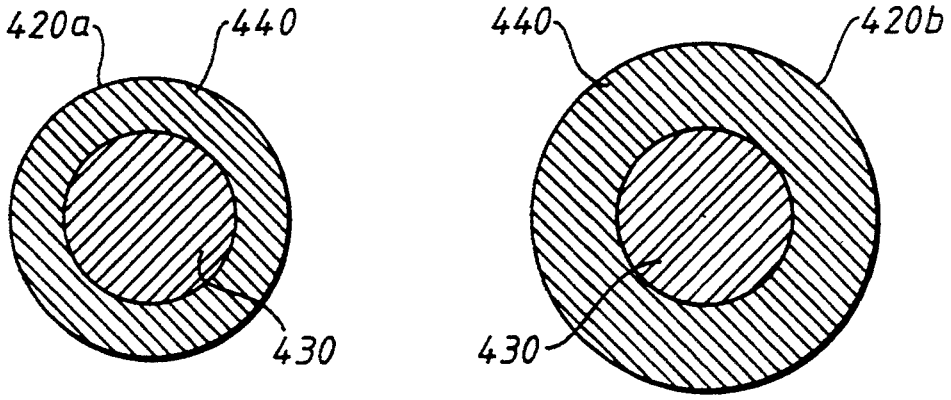
FIGS. 9(*a*) to 9(*c*) are sectional views showing different types of micro capsules 420.
Figure 9B:
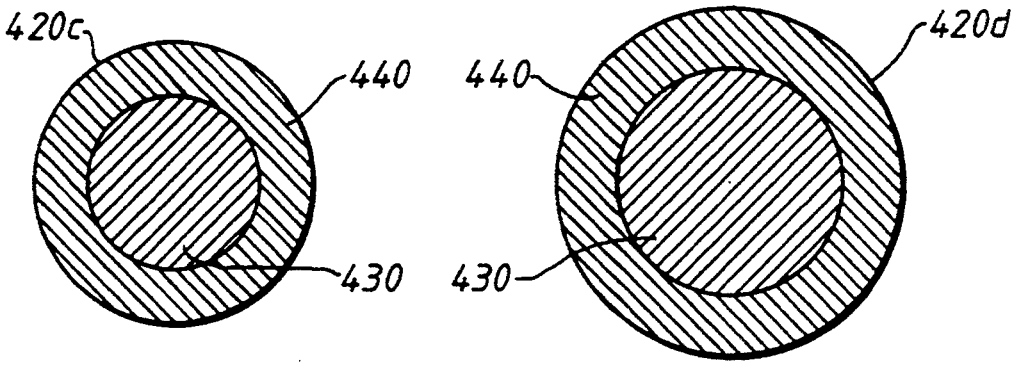
Figure 9C:
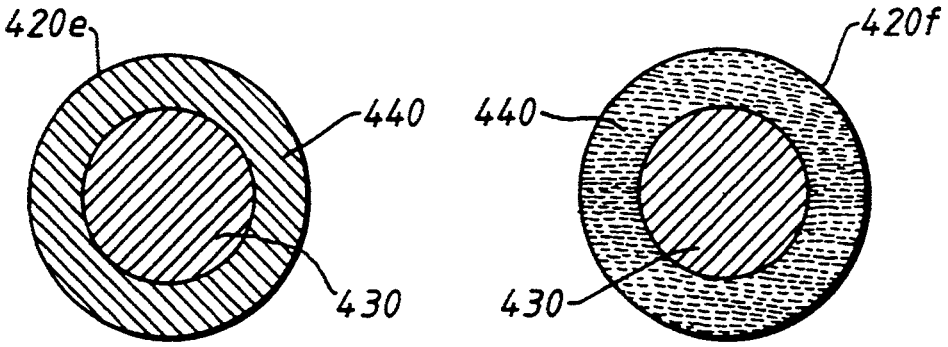

FIGS. 9(*a*) to 9(*c*) show sectional views of a variety of types of the micro capsules 420. FIG. 9(*a*) shows two kinds of the micro capsules 420*a* and 420*b* with the shell 440 of each having a different film thickness "t". FIG. 9(*b*) shows two kinds of micro capsules 420*c* and 420*d* with the shell 440 of each having the different inner diameter "r", and FIG. 9(*c*) shows two kinds of the micro capsules 420*e* and 420*f* which are the same in the shape but differ in material used.

Of the micro capsules 420*a* and 420*b* shown in FIG. 9(*a*), the micro capsule 420*a*, of which shell 440 has the thinner thickness "t" and of the micro capsules 420*c* and 420*d* shown in FIG. 9(*b*), the micro capsule 420*d* which has the larger inner diameter "r" will expand at a lower temperature.

Further, even when the capsules are in the same shape, if the ratio of the specific gravity and the molecular weight p/M of the heat expansion material 430 contained in the micro capsules 420 differs, the expansion starting temperature differs because of the difference in the inner pressure "P" and further, when a temperature at where the elastic limiting stress "q" changes according to the material of the shell 440, the expansion starting temperature also differs. For instance, when a polyvinylidene, i.e., a copolymer of vinylidene chloride and acrylic nitrile is used as a material of the shell 440, it is possible to mold a shell having a different expansion starting temperature by changing a blending ratio of the vinylidene chloride and the acrylic nitrile.

For instance, a shell composed of vinylidene chloride and acrylic nitrile at a ratio of 8 : 2 has the expansion starting temperature lower than that of a shell composed of the same materials at 5 : 5 by about 20° C. to 25° C.

Thus, it is possible to mold the micro capsules 420 in different expansion starting temperatures by changing shapes or blending ratios of materials. By combining these multiple kinds of the micro capsules 420 in the same ink ribbon 400, it is possible to control a degree of expansion of the micro capsules 420 in response to the temperature of the thermal head 360. The recording of gradation or a toned image recording becomes possible.

Thermal cracking or blowing agents or volatile liquids of low boiling points are used as the heat expansion material 430 contained in the micro capsules 420, as described above. Compounds of blowing agents which generate gas through thermal cracking generally used in the field of resin processing, etc. are also usable as foaming agents in the present invention. Further, compounds of evaporating or volatile blowing agents generally used in the field of resin processing can be used for volatile liquids.

As thermal cracking blowing agents, organic blowing agents such as diazoamino derivatives, azo compounds, sulfonhydrazide compounds, nitroso compounds, etc. and inorganic foaming agents such as bicarbonate, carbonate, azide, etc.; as definite examples of organic foaming agents, for instance, diazoamino derivatives, 1, 3 bis-O-biphenyltriazine, diazoaminobenzene, 1-methyl-3-phenyltriazine, etc.; as azo compounds, azobishexahydrobenzodinitrile, azodicarbon amide, azobisisobutynitrile, diazoaminobenzene, diazo acid amide, etc.; as sulfonic hydrazide compounds, benzene sulfonic acid hydrazide, 4, 4-bis (hydrazinosulfonil) diphenylether, p-toluenesulfonil hydrazide, benzenesulfonil hydrazide, p,p-oxybisbenzenesulfonilhydrazide, diphenylsulfone, S,S-disulfonilhydrazide, 4, 4-oxybisbenzenesulfonilhydrazide, etc.: as nitroso compounds, N,N-dinitroso-N,N-dimethyl terephthal amide, N,N-dinitroso pentaethylene tetraamine, N,N-dimethyl-N, N--dinitro terephthal amide, etc. are available.

As definite examples of inorganic foaming agents, for instance, as bicarbonate, sodium bicarbonate, ammonium bicarbonate, etc.: as carbonate, Sodium bicarbonate, ammonium carbonate, magnesium carbonate, etc.; as azide, $CAN_6$, $BaN_6$ etc. are available.

As a volatile liquid of low boiling point, for instance, isobutane is available. As for other examples, for instance, materials disclosed in the Japanese Patent Disclosure Tokkai-Sho No. 60-25792, for instance, propane, pentans, hexane, etc., are available- As other definite examples, trichlorofluoromethane, dichlorofluoromethane, dichlorotetrafluoroethane, normal butane, butylene, $CO_2$, acetone, methylene chloride, trichlorofluoromethane, trichlorotrifloromethane, petroleum ether, etc. are available. These blowing agents may used individually or in combinations of two or more.

Generally, volatile liquids of low boiling points are in a liquid state under normal temperature and pressure. As volatile liquid of low boiling temperature to be contained in the micro capsule 420 for use in the ink ribbon 400 of this invention, materials which become liquid under a pressure above the normal pressure (for instance, in the micro capsule), for instance, isobutane, neopentane, propane, freon, etc. are preferred.

Figure 10:
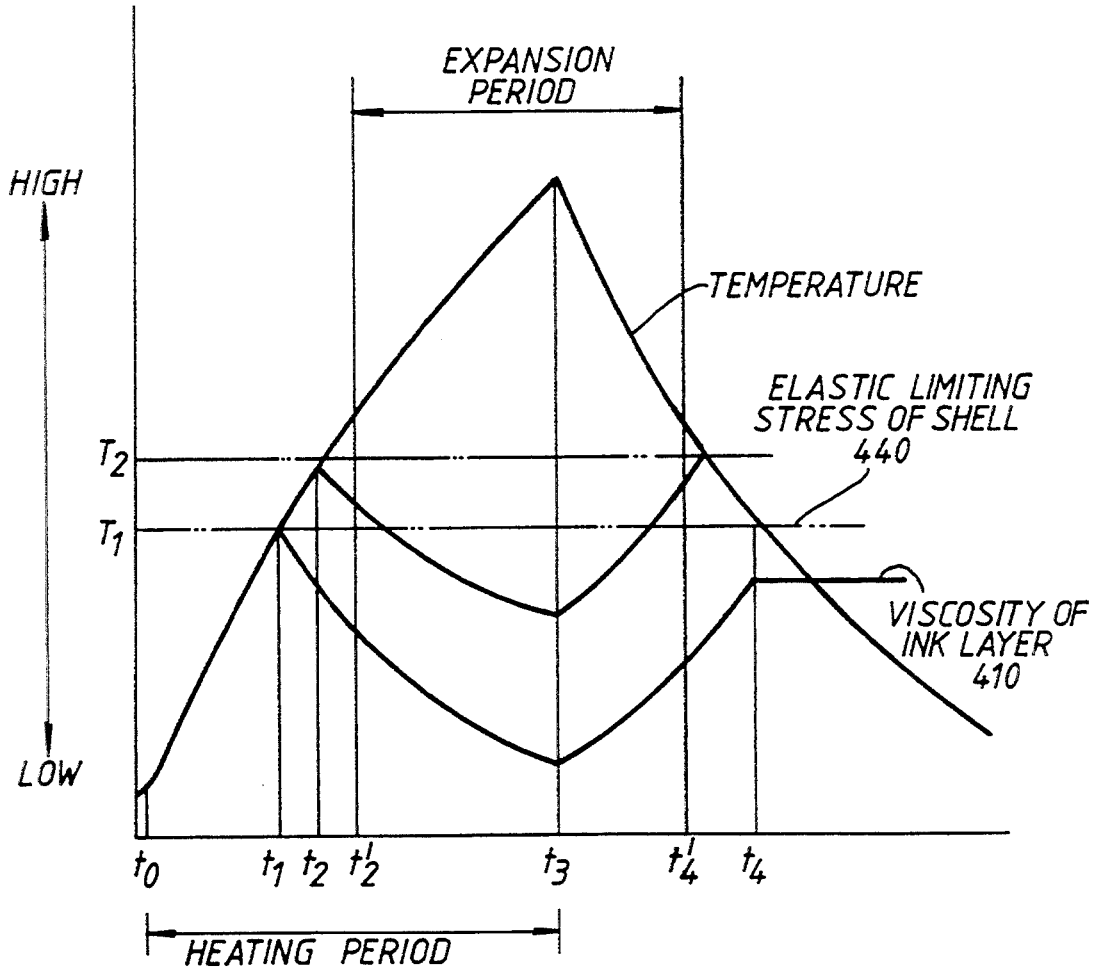
FIG. 10 is a graph showing a viscosity of the thermoplastic ink layer 410 and an elastic limiting stress of the shell 440.
Figure 11A:
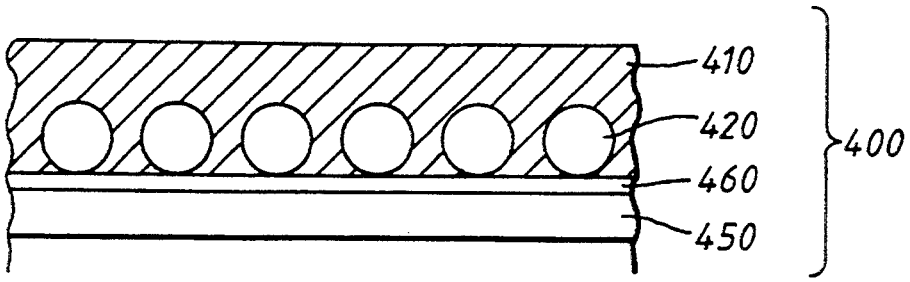
FIGS. 11(*a*) to 11(*d*) are sectional views showing modifications of the ink ribbon 400, in which intermediate layers 460 are provided.
Figure 11B:
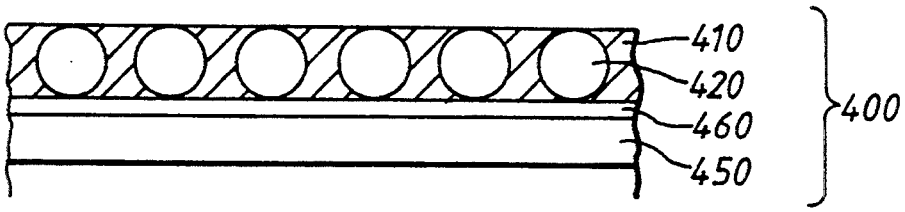
Figure 11C:
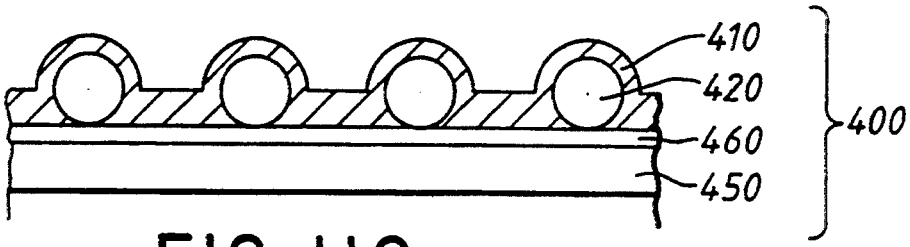
Figure 11D:
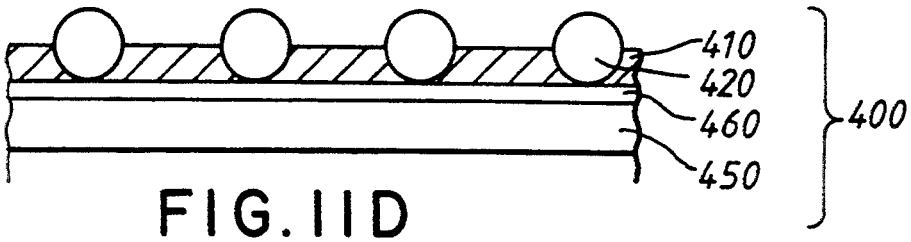
Figure 12A:
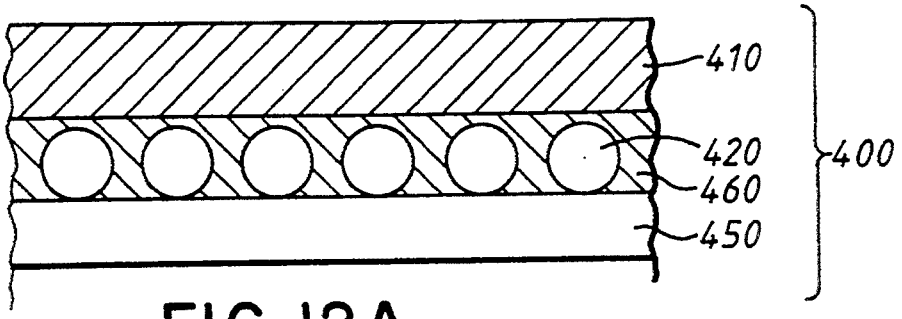
FIGS. 12(*a*) to 12(*d*) are sectional views showing modifications of the ink ribbon 400, in which micro capsules 420 are dispersed in the intermediate layers 460.
Figure 12B:
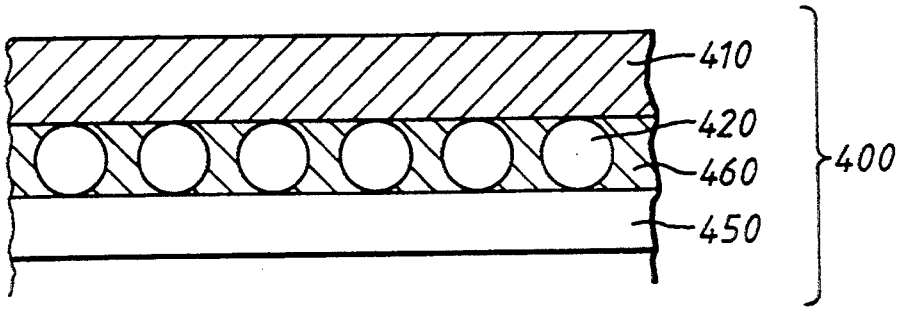
Figure 12C:
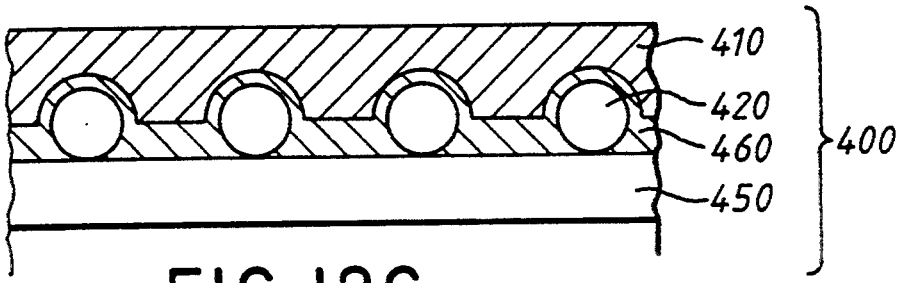
Figure 12D:
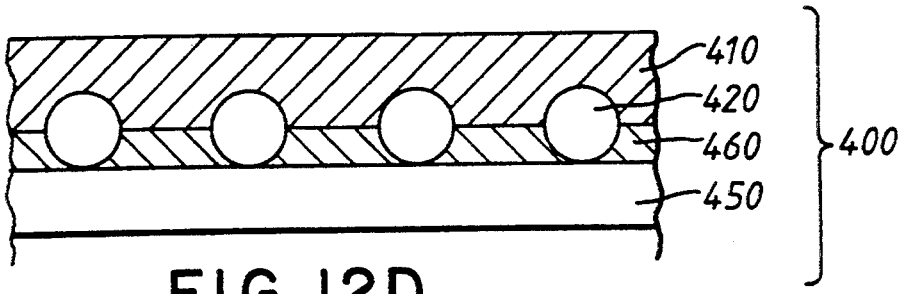
Figure 13A:
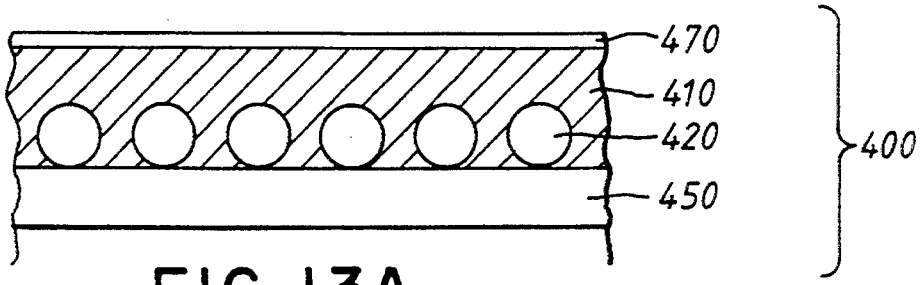
FIGS. 13(*a*) to 13(*e*) are sectional views showing modifications of the ink ribbon 400, in which overcoat layers 470 are further provided.
Figure 13B:
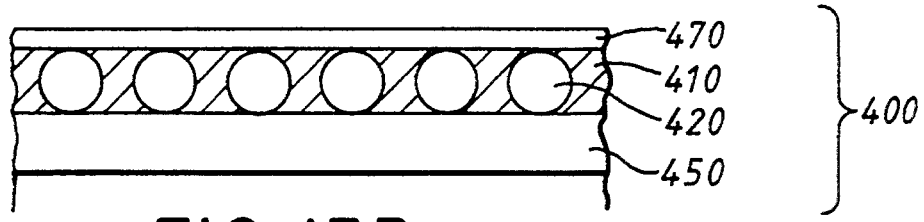
Figure 13C:
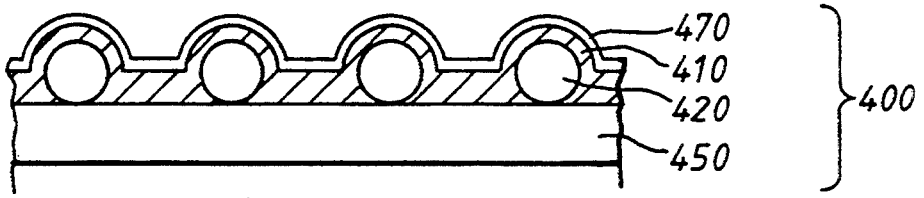
Figure 13D:
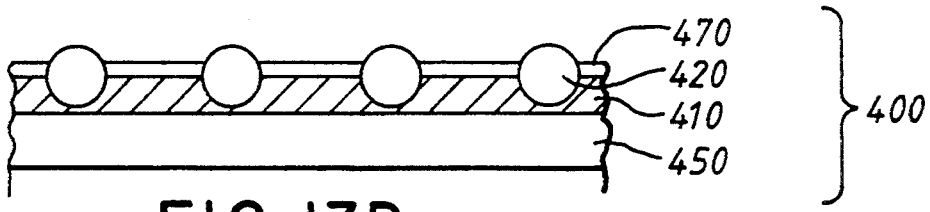
Figure 13E:
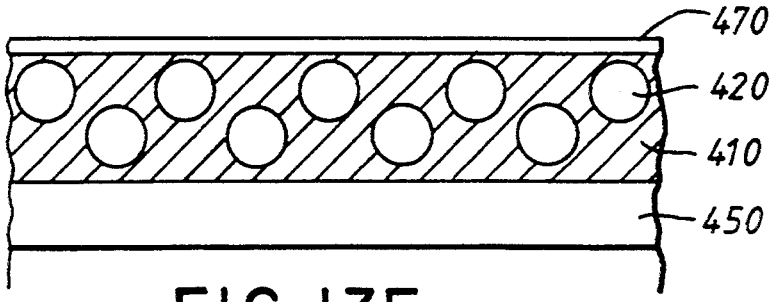

FIG. 10 is a graph showing a viscosity of the thermoplastic ink layer 410 and an elastic limiting stress of the shell 440.

As shown in FIG. 10, when heat is transmitted from the thermal head 360 to the melting ink layer 410, the temperature of the printing section begins to rise (at the time t0) and when the heating ends (at the time t3), the temperature goes down immediately. Viscosity of the thermoplastic ink layer 410 begins to drop from the binder's softening temperature T1 (at the time t1) and goes up with temperature drop.

Further, the elastic limiting stress of the shell 440 begins to decrease from the softening temperature T2 (at the time t2) after the binder begins to soften, and increases with temperature drop. Therefore, the shell 440 begins to expand at the time t2 when the inner pressure "P" exceeds the strength of the shell 440 after the shell 440 begins to soften and lasts until the inner pressure becomes equal to atmospheric pressure. If temperature drops too fast, the expansion stops at the time t4 when the inner pressure "P" at the time t4 drops below the strength of the shell 440. Therefore, to have the micro capsule 420 expand completely, it is required to keep the micro capsule 420 at a high temperature for a sufficient period of time until the expansion ends.

If the expansion starting temperature of the micro capsules 420 is higher than the softening temperature of the binder, the micro capsules 420 begin to expand after the binder has been softened and therefore, there is no problem as far as the ink transfer is concerned. However, if it is lower than the softening temperature of the binder, the micro capsules 420 begin to expand before the binder is softened.

When the micro capsules 420 are projecting from the ink layer 410 (see FIG. 7(*d*), the projected portions only expand and no effect to push out the ink is obtainable. Further, if the micro capsules 420 have been buried in the ink layer completely (see FIG. 7(*a*)), the start of expansion is delayed and it becomes difficult to expand the micro capsules 420 completely.

The micro capsules 420 containing blowing agents are achieved by a well known micro encapsulating method. For instance, in case of a water solution type, a spray drying method in which the dispersed solution of a non-water solution type blowing agent achieved by dispersing the blowing agent in the water solution, which becomes a shell material, in the form of suspension or emulsion is sprayed and dried, a phase separation method, a pumplex coacervation method, a surface polymerization method, an "in situ" polymerization method, etc. are available.

There are two types in the micro capsules 420 containing volatile liquid of low boiling point, i.e., a type of containing volatile liquid of low boiling point itself and another type containing fine resin particles with a volatile liquid of low boiling point impregnated into the particles. The micro capsules containing volatile liquid of low boiling point itself are achieved by a well known micro encapsulation method.

For instance, in case of water solution type, the spray drying method in which the dispersed solution of volatile liquid of low boiling point (non-water soluble) obtained by dispersing it in the water solution which becomes the shell material in the form of suspension or emulsion is sprayed and dried, the phase separation method, the pumplex coacervation method, the surface polymerization method, etc. are also available. These methods are disclosed in detail in the Japanese Patent Disclosure Tokkai-Sho No. 42-26524.

Further, as the monomers which are used for the shell 440 of the micro capsule 420 obtained by the polymerization, materials disclosed in the Japanese Patent Disclosure Tokkai-Sho No. 42-26524, for instance, alkenyl aromatic monomers such as styrene, o-methylstyrene, m-methylstyrene, p-methylstyrene, ethyl styrene, ar-vinyl-xylene, archlorostyrene, ar-bromostyrene, etc.; styrene derived compounds such as vinylbenzylchloride, p-tert.-butylstyrene, etc.; such acrylate materials as methyl methacrylate, ethyl acrylate, propyl acrylate, butyl acrylate, butyl methacrylate, propyl methacrylate, butyl methacrylate, lauryl acrylate, 2-ethylhexylacrylate, ethyl methacrylate, etc.; esters such as vinyl acetate, vinyl butylate, vinyl acetate, vinyl laurate, vinyl myrislate, vinyl propoinate, etc. and in addition, vinyl chloride, vinyliden chloride, vinyl bromide, acrylonitrile, etc. are available.

Further, as materials of the shell 440 that is definitely molded, materials listed shown below are available for use in the phase separation method, the surface polymerization method and the "in situ" method:

Phase Separation Method:

Polyvinyl acetate, styrene maleic acid copolymer, benzylcellulose, ethylcellulose, polyethylene nitrocellulose, ketone resin, polymethylmethacrylate, polyamide resin, acrylonitrilestyrene copolymer, vinylidenchlorideacrylonitrile copolymer, epoxy resin, etc.

Pumplex Coacervation Method:

Gelatin, acrylic resins. Surface Polymerization Method: Polyamide, polysulfonamide, polyurea, polyurethane, polyester, polyamideurethane, polyamideurea, polysulfonamideurea, polyestersulfonate, etc.

"In situ" Polymerization Method:

Polystyrene, polyurethane, ureas formalin, etc.

Further, when impregnating volatile liquid into fine resin particles, various methods are available; for instance, a method to add volatile liquid in the process to suspend and polymerize proper monomer (see the Japanese Patent Disclosure Tokai-Sho 33-3190) and a method to add volatile liquid by swelling beads obtained through suspension and polymerization in solvent (see the Japanese Patent Disclosure Tokkai-Sho 36-10628). In addition, there is also a method to impregnate volatile liquid after making resins in fine particles when needed.

Further, a cracking temperature of a blowing agent is adjustable by adding a blowing additive when needed. For instance, compounds that lower the cracking temperature, as disclosed in the Japanese Patent Disclosure Tokkai-Sho No. 60-25792, for instance, acetic acid, lactic acid, citric acid, etc., are pointed out. Further, it is possible to perform the surface treatment, for instance, containment of dispersion agent to facilitate dispersion, and the coating of a coloring agent. Similarly, it is also possible to contain a dispersion agent and filter in the binder, as necessary.

For the base film 450, such plastic films as polyethylene terephthalate, polyamide, polyester, polycarbonate, triacetylcellulose, nylon, cellophane, etc., and such thin papers as condenser paper, glassine paper, sulfate paper, etc., .are usable. The thickness of the base film is 2 to 15 μm, but 3 to 6 μm is especially preferred. Further, the durability of the base film 450 can be improved by providing a heat-resisting layer made of silicon resin, fluorine resin, polyimide resin, epoxy resin, phenol resin, melanine resin, polyester resin, vinyl ester resin or nitrocellulose on the surface contacting the thermal head 360.

The ink ribbon 400 can be manufactured by well known techniques, e.g., the hot-melt coating technique, the solvent coating technique, etc. According to the hot-melt coating technique, a coating solution to become the thermoplastic ink layer 410 is prepared by dispersing the micro capsule 400 containing the heat expansion material 430 in another coating solution comprising the above-described binders formed under heating condition and the coloring agents as principal constituents under a temperature lower than the expansion start temperature of the heat expansion material 430. The resultant coating solution is coated on a base film by coating equipment, such as a barcoater, and then dried.

According to the solvent coating technique, a coating solution to become the thermoplastic ink layer 41D is prepared by dispersing the micro capsule 400 containing the heat expansion material 430 in another coating solution comprising the above-described binders formed under heating conditions and with the coloring agents as principal constituents. The resultant coating solution is coated on a base film by using coating equipment, such as a barcoater, and then dried.

The ink ribbon 400 according to the present invention can be modified as shown in FIGS. 11(*a*) to 11(*d*). These aspects of the ink ribbon 400 comprise an intermediate layer 460 between the thermoplastic ink layer 410 and the base film 450. The intermediate layer 460 is a parting compound layer, making it easier for the layer of thermoplastic ink layer 410 to part from the base film 450. In another application, the intermediate layer 460 is an adhesive compound layer for securing adhesion of thermoplastic ink layer 410 to the base film 450. In still another application, the intermediate layer 460 is a surface active agent layer forming it easy to achieve the coating of the layer of the thermoplastic ink layer 410 to the base film 450. In these aspects of the ink ribbon 400, the micro capsules 420 are dispersed in contact with the surface of the intermediate layer 460, as shown in FIG. 11(*a*) to 11(*d*).

In the various forths of the ink ribbon 400, the layer of the thermoplastic ink layer 410 can be thicker than the diameter of the micro capsules 420, as shown in FIG. 11(*a*). However, the thickness of the thermoplastic ink layer 410 can be equal to, or thinner than the diameter of the micro capsules 420, as shown in FIGS. 11(*b*) to 11(*d*). In the case of FIG. 11(*c*), the parts of the micro capsules 420 projecting from the thermoplastic ink layer 410 are covered with a thin layer of the thermoplastic ink. In the case of FIG. 11(*d*), the parts of the micro capsules 420 project from the thermoplastic ink layer 410 without being covered with such a thin layer of the thermoplastic ink.

The intermediate layer 460 forming the parting compound layer consists of a binder, and a coloring agent if necessary. The coloring agent for the binder is selected from the above described waxes, plastics, pigments and dyes, similar to those used for the thermoplastic ink layer 410. The melting point and the viscoelasticity of the binder for the parting compound layer are essentially lower than those of the binder for the thermoplastic ink layer 410. The thickness of the intermediate layer 460 is preferred to be less than 10 μm, in particular, in the range of 0.1 to 5 μm.

In the aspects of the ink ribbon 400 as shown in FIGS. 11(*a*) to 11(*d*), other conditions such as the materials, the components, the amounts, the sizes, etc. of the ink ribbon 400, and the dispersion of the micro capsules 420 in the thermoplastic ink layer 410 are substantially the same as those as shown in FIGS. 7(*a*) to 7(*d*). The manufacturing method of the ink ribbon 400 as shown in FIGS. 11(*a*) to 11(*d*) is also selected from well techniques, such as the hot-melt coating technique and the solvent coating technique, as for ink ribbon 400 in FIGS. 7(*a*) to 7(*d*). In the manufacturing method using the hot-melt coating technique, the intermediate layer 460, including the binder and the coloring agent as the principal constituents and the thermoplastic ink layer 410 in which the micro capsules 420 are dispersed are coated on the base film 450 in this order. In this manufacturing method using the solvent coating technique, the intermediate layer 460 and the thermoplastic ink layer 410 are coated on the base film 450 in the saute order as with the hot-melt coating technique.

The micro capsules 420 can be dispersed in the intermediate layer 460, as shown in FIGS. 12(*a*) to 12(*d*), instead of in the thermoplastic ink layer 410. A similar construction is disclosed in Japanese Patent Disclosure Tokkai-Sho 60-176490. In this Patent Disclosure, however, an ink ribbon 400 is provided with an intermediate layer 460 containing heat expansion material 430 between a thermoplastic ink layer 410 and a base film 450 for the purpose of adapting the printing process for rough surface paper.

In FIGS. 12(*a*) to 12(*d*), the micro capsules 420 dispersed in the intermediate layer 460 are in contact with the base film 450. The diameter of the micro capsules 420 is preferred to be set in the range of 1 to 10 μm before expansion. Their maximum diameter, after expansion, is preferred to be in the range of 2 to 60 82 m. The thickness of the thermoplastic ink layer 410 is preferred to be set in the range of 1 to 20 μm (2 to 10 μm). The thickness of the intermediate layer 460 is preferred to be less than 10 μm (0.1 to 5 μm). It is especially preferable that they have the values in the parentheses.

In the embodiments of the ink ribbon 400 as shown in FIGS. 12(*a*) to 12(*d*), other conditions such as the materials, components, amounts, sizes, etc. of ink ribbon 400, and the dispersion of the micro capsules 420 in the thermoplastic ink layer 410, are substantially the same as those as shown in FIGS. 7(*a*) to 7(*d*). The manufacturing method of the ink ribbon 400 as shown in FIGS. 11(*a*) to 11(*d*) is also selected from the well known techniques, such as the hot-melt coating technique and the solvent coating technique, similar to manufacture of the ink ribbon 400, as shown in FIGS. 7(*a*) to 7(*d*). In the manufacturing method using the hot-melt coating technique, the intermediate layer 460, including the binder and coloring agent as the principal constituents and the thermoplastic ink layer 410 in which the micro capsules 420 are dispersed are coated on the base film 450 in the above-mentioned order. In the manufacturing method using the solvent coating technique, the intermediate layer 460 and the thermoplastic ink layer 410 are coated on the base film 450 in the same order as the hot-melt coating technique.

In these aspects of the ink ribbon 400, the diameter of the micro capsules 420 can be thinner than the thickness of the intermediate layer 460, as shown in FIG. 12(*a*). However, the diameter of micro capsules 420 can be equal to, or thicker than the thickness of the intermediate layer 460, as shown in FIGS. 12(*b*) to 12(*d*). In the case of FIG. 12(*c*), the parts of the micro capsules 420 projecting from the intermediate layer 460 are covered with a thin layer of the binder of intermediate layer 460. In FIG. 11(*d*), the parts of the micro capsules 420 project from the thermoplastic ink layer 410 without being covered with such a thin layer.

The ink ribbon 400 can be covered with an overcoat layer 470 (referred to as coating layer hereinafter) for the purpose of preventing fogging, as shown in FIGS. 13(*a*) to 13(*e*). In one aspect, the coating layer 470 is used for raising the softening temperature of the ink ribbon 400 above that of the thermoplastic ink layer 410. Also in another aspect, the coating layer 470 can be colorless and transparent. In the former embodiment, the coating layer 470 contains a coloring agent and a binder. In the latter embodiment, the coating layer 470 contains a binder without a coloring agent. The coloring agent and the binder can be selected from the above described pigments, dyes, waxes and plastics used in the thermoplastic ink layer 410. The thickness of the coating layer 470 is preferred to be set less than 10 μm, in particular, in the range of 0.1 to 5 μm.

In the ink ribbon 400, as shown in FIGS. 13(*a*) to 13(*e*), other conditions such as the materials, components, amounts, sizes, etc. of the ink ribbon 400 are substantially the same as those as shown in FIGS. 7(*a*) to 7(*d*). The manufacturing method of ink ribbon 400 as shown in FIGS. 13(*a*) to 13(*e*) is also selected from well known techniques, such as the hot-melt coating technique and the solvent coating technique, is similar to that used for the ink ribbon 400, as shown in FIGS. 7(*a*) to 7(*d*). In the manufacturing method using the hot-melt coating technique, the thermoplastic ink layer 410 in which the micro capsules 420 are dispersed by a temperature lower than the expansion start temperature and the coating layer 470 containing the binder as the principal constituent are coated on the base film 450 in the given order. In the manufacturing method using the solvent coating technique, the thermoplastic ink layer 410 and the coating layer 470 are coated on the base film 450 in this order for using the hot-melt coating technique.

The coating layer 470 is also applicable to the ink ribbon 400 with the intermediate layer 460, as shown in FIGS. 11(*a*) to 11(*d*), or the ink ribbon with the micro capsules 420 dispersed in the intermediate layer 460 as shown in FIGS. 12(*a*) to 12(*d*).

Figure 14A:
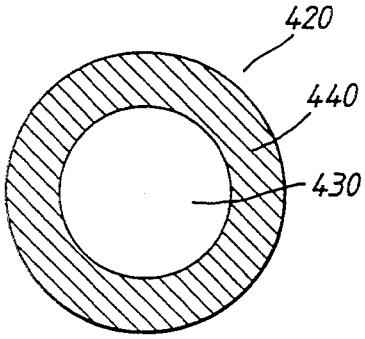
FIGS. 14(*a*) to 14(*c*) are sectional views illustrating three aspects of coloring by the micro capsule 420.
Figure 14B:
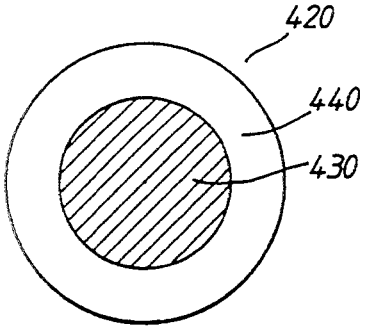
Figure 14C:
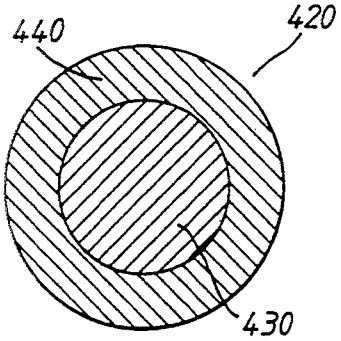
Figure 16A:
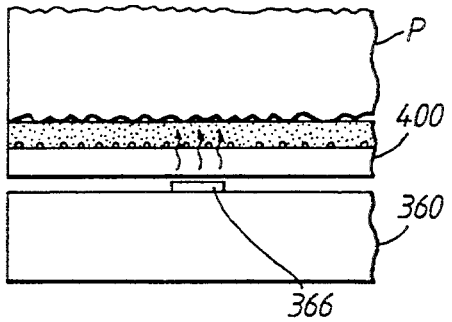
FIGS. 16(*a*) to 16(*d*) are diagrammatical sections illustrating the flow of printing operation carried out on a recording paper P by using the ink ribbon 400 and the thermal head 360.
Figure 16B:
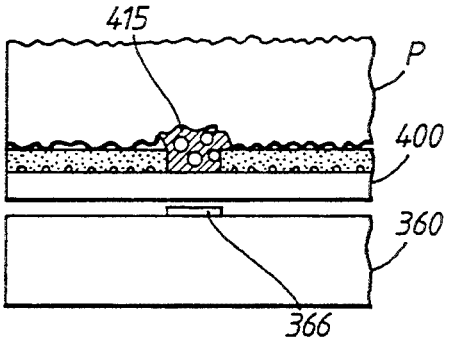
Figure 16C:
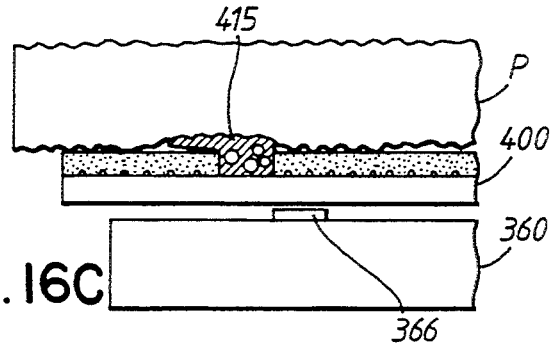
Figure 16D:
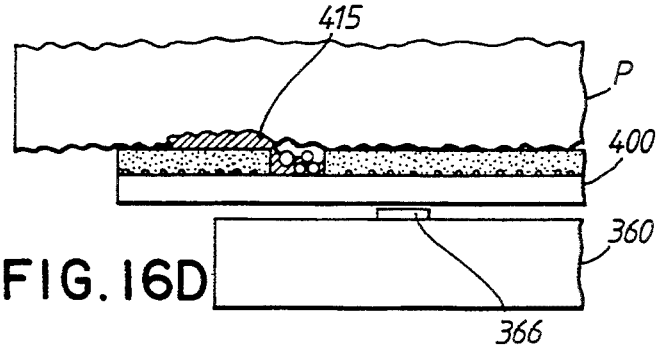

The micro capsules 420 can have the same color as the color of the thermoplastic ink layer 410. FIGS. 14(*a*) to 14(*c*) show three types of coloring for the micro capsule 420. In FIG. 14(*a*), the coloring is made on the shell 440. In FIG. 14(*b*), the coloring is made on the heat expansion material 430 with low boiling point. In FIG. 14(*c*), the coloring is made on both the shell 440 and the heat expansion material 430.

Such a coloring agent of the micro capsules 420 can be selected from inorganic pigments, organic pigments and dyes. As inorganic pigments, there are natural chromate, ferrocyanide, oxide, sulfide, sulfate, silicate, metallic powders, etc. As organic pigment, there are natural lake, nitroso lake, azoic lake, phthalocyanine lake, fused multi-ring lake, basic lake, mordant-dye lake, vat-dye lake, etc. As dye, there are water-soluble dye, oil-soluble dye, etc.

As the embodiments of inorganic pigment, there are chromate such as natural rare-earth pigments, chrome yellow, zink yellow, barium yellow, chrome orange, molybdenum red, chrome green, etc., ferrocyanide such as Prussian blue, oxide such as titanium oxide, titanium yellow, titanium white, red iron, iron oxide yellow, zinc ferrite, zinc white, iron black, cobalt blue, chromium oxide, spinel green, etc., sulfide such as cadmium yellow, cadmium orange, cadmium red, etc., sulfate such as barium sulfate, etc., silicate such as calcium silicate, Prussian blue, etc., metallic powders such as bronze, aluminum, etc., carbon black, etc.

As the embodiments of organic pigment, there are natural lakes, such as madder lake, etc., nitroso lake such as naphthol green, naphthol orange, etc., soluble azoic pigment (azoic lake) such as benzidine yellow G, hansa yellow G, hansa yellow 10G, vulcanized orange, lake red R, lake red C, lake red D, watchung red, brilliant carmine 6B, pyrazolone orange, Bordeaux 10B (BON Maroon), etc., nonsoluble azoic pigment such as pyrazolone red, para red, Toluidine red (lake red 4R), Toluidine Maroon, brilliant faced scarlet, lake Bordeaux 5B, fused azoic pigments, phthalocyanine pigment such as phthalocyanine blue, phthalocyanine green, bromo-phthalocyanine green, Fast sky blue, etc., anthraquinone fused multi-ring pigment such as Indanthrene blue, etc., perylene fused multi-ring pigment such as perylenemaroon, etc., quinacridone fused multi-ring pigment such as quinacridone, dimethyl quinacridone, etc., dioxazine fused multi-ring pigment such as dioxazine violet, etc., isoindolinone fused multi-ring pigment, quinophthalone fused multi-ring pigment, basic lake such as Rhodamine 6B lake, Rhodamine lake B, Malachite green, etc., mordant dye pigment such as Alizalin lake, etc., vat dye pigment such as indanthrene blue, Indigo blue, Anthantorone orange, etc., fluorescent pigment, azine pigment (diamond black), green gold, etc.

As the embodiments of water-soluble dye, there are basic due such as Rhodamine B, etc., acid dye such as orange II, etc., fluorescent dye. etc.

AM the embodiments of oil.-soluble dye, there are monoazoic dye such as Fast orange R, oil red, oil yellow, etc., anthraquinone dye such as anthraquinone violet, etc., azine dye, basic dye, acid dye, metal complex compound dye, etc.

For coloring micro capsule 420 containing browing agent, a well known micro encapsulating technique is used. In case of water solution type, there are a spray drying method for spray and drying a dispersion liquid achieved by dispersing non-water-soluble browing agent in the form of suspension or emulsion in a water solution containing a coloring agent, a phase separation method, pumplex coacervation method, an interfacial polymerization method, an "in situ" polymerization method, etc.

For the micro capsule 420 containing volatile liquid with low boiling point, coloring is carried out on the volatile liquid with a low boiling point, or plastic particles impeded with the volatile liquid with low boiling point. The micro capsule 420 containing the colored volatile liquid with low boiling point can be achieved by a well known micro encapsulating technique. In the case of the water solution type, there is a spray drying method for spray and drying dispersion liquid achieved by dispersing the volatile liquid with low boiling point (non-water soluble) in the form of suspension or emulsion in a water solution to become a shell material containing a coloring agent. In the case of micro capsule 420 containing therein a volatile liquid with low boiling point and a coloring agent, there is a spray drying method for spray and drying a dispersion liquid achieved by dispersing a non-water soluble mixture containing a volatile liquid with low boiling point and a coloring agent in the form of suspension or emulsion in a water solution to become a shell material. There are also a phase separation method, pumplex coacervation method, an interfacial polymerization method, etc.

As a monomer for the shell 440 of the micro capsule 420 achieved by duplexing, a material such as disclosed in the Japanese Patent Tokko-Sho 42-26524, e.g., vinylidene chloride, the acrylonitrile, etc. is easy to be colored. For impeding a coloring agent into the plastic particle 433, methods disclosed in the aforementioned Japanese Patent Tokko-Sho 33-3190, the Tokko-Sho 36-10628, etc. can be used.

Further, the coloring can be applied to an additive for adjusting the decomposition temperature of the browing agent. For example, the coloring is applied to compounds disclosed in the Japanese Patent Disclosure Tokkai-Sho 60-25792, which are effective for lowering the decomposition temperature, e.g., oxalic acid, lactic acid, citric acid, etc. Similarly, the coloring can be applied to the dispersing agent, the filler. etc.

As other examples of the method for coloring the shell 440, there are a method of dying the shell 440 after the micro capsule 420 has been formed, a method of coating the surface of the shell 440, etc.

In the case of dying, a well known dying method, such as direct dying, mordant dying, reduced dying, oxidization dying, revelation dying, reaction dying, etc. can be used.

The coating of the surface of shell 440 can be selected from a wet coating method using a coupling force according to a liquid bridging or a solid bridging of the binder, a dry coating method using a coupling force according to a van der Waals force, an electrostatic: force or a mechanochemical force and a well known micro encapsulating method.

In the above embodiments of the ink ribbon 400, the description is made on the thermoplastic ink layer 410 coated on the base film 450 at a single layer. However, the thermoplastic ink layer 410 can be coated in two layers or more, if necessary.

Now the recording operation of the image forming apparatus using the ink ribbons described above will be described in reference to FIG. 15.

Figure 15:
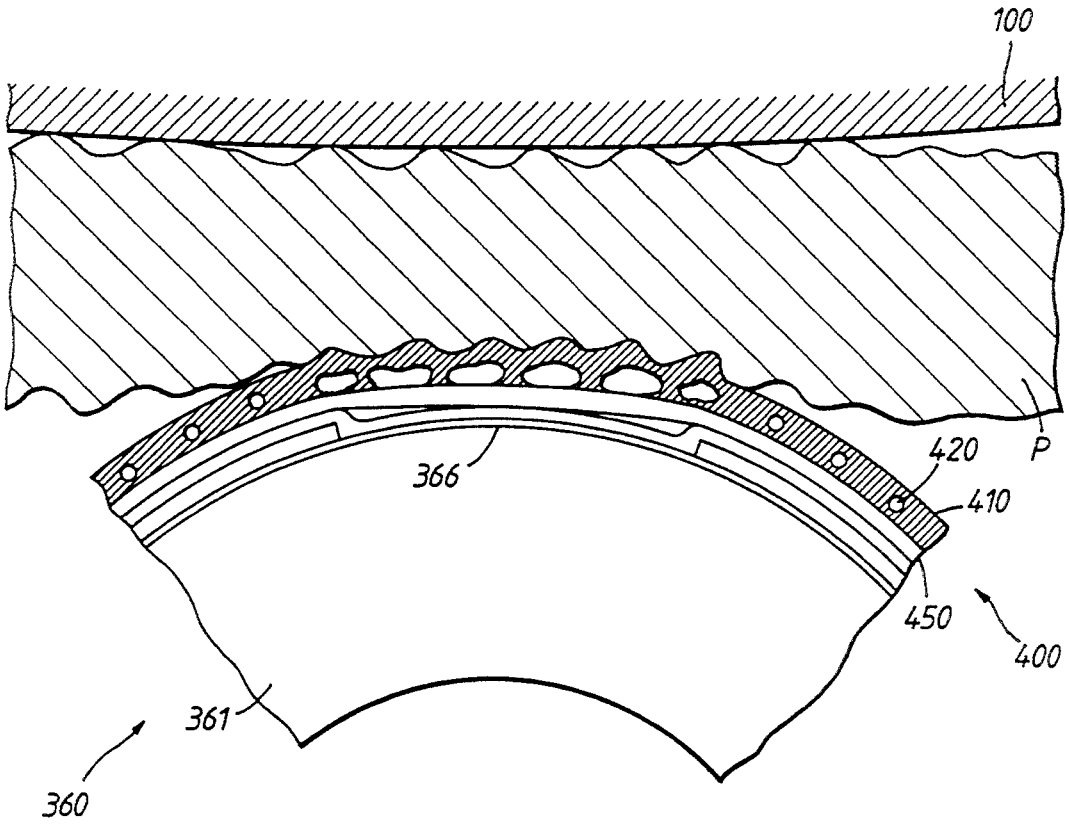
FIG. 15 is a sectional view showing printing and separation in the recording operation on a paper P, by using the ink ribbon 400.

FIG. 15 is a sectional view illustrating printing and separation in the recording operation on a paper P by using the ink ribbon 400.

The ink ribbon 400 is heated by Joule heat generated from the heating resistor 366 formed on the thermal head 360 from under the base film 450. The Joule heat conducts to the thermoplastic ink layer 410 through the base film 450. The joule heat then softens and melts the thermoplastic ink layer 410. The joule heat also expands the micro capsules 420 containing the heat expansion material 430, dispersed in the thermoplastic ink layer 410. As a result, the expanded micro capsules 420 adhere the melted thermoplastic ink on the surface of the paper P.

Figure 23:
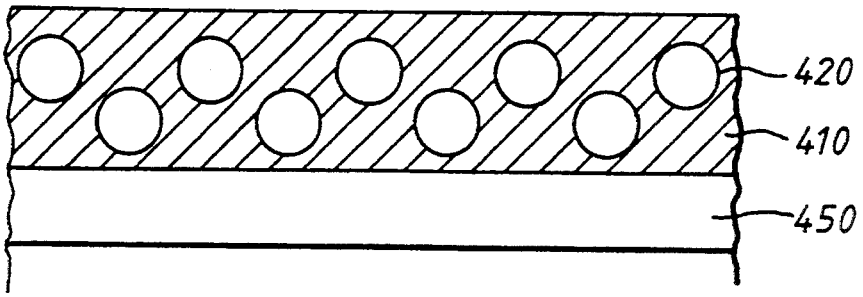
FIG. 23 is a sectional view showing the ink ribbon 400 in which micro capsules 420 are apart from the base film 450.

The thermal head 360 has the highest temperature at its surface, but the temperature is lowered at the thermoplastic ink layer 410 due to the heat dissipation by the difference of the heat conduction characteristics and heat radiation. This causes a temperature difference among the temperatures from the base film 450, the thermoplastic ink layer 410 and the paper P. Accordingly, the dispersion of the micro capsules 420 in the thermoplastic ink layer 410 is preferable to take the state as shown in FIGS. 7(*a*) to 7(*d*), therein the micro capsules 420 are in contact with the base film 450, than the state as shown in FIG. 23, therein the micro capsules 420 are apart from the base film 450. According to the dispersion state of the micro capsules 420 as shown in FIGS. 7(*a*) to 7(*d*), the heat conduction to the micro capsules 420 is increased and unified so that the expansion of the micro capsules 420 is largely enforced and secured.

Figure 24:
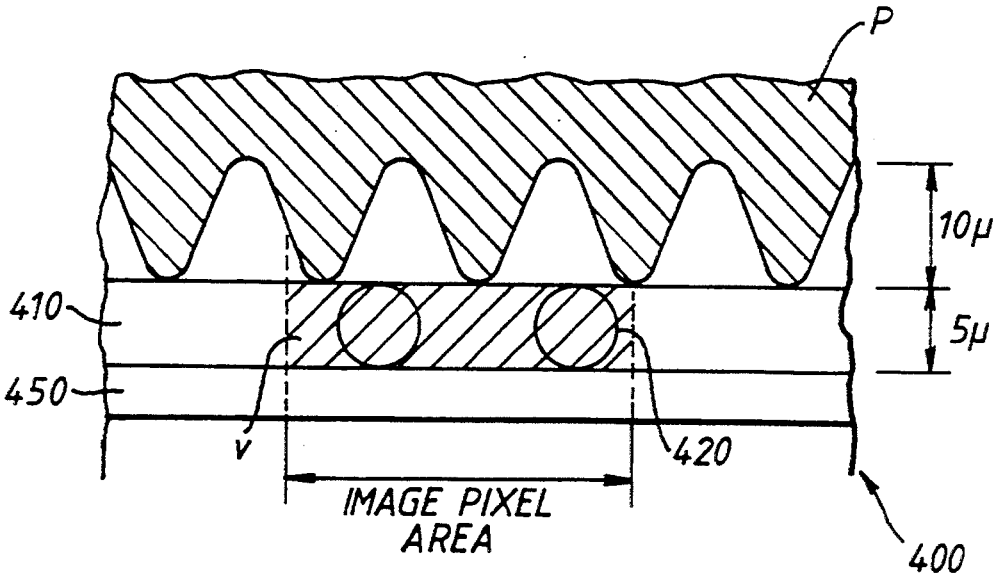
FIG. 24 is a sectional view illustrating the printing operation for a rough surface paper.

The micro capsules 420 are made elastic by the heat, so that they become easy to deform in comparison to the deformation of the thermoplastic ink layer 410. Then, the micro capsules 420 expand with a deformation of a water cushion shape. As a result, the melted thermoplastic ink of the thermoplastic ink layer 410 is easily pressed into depressions on the surface of the paper P by the deformed expansion of the micro capsules 420. Thus, the image forming apparatus according to the embodiments of the ink ribbon 400 can achieve printing with good quality even for a recording paper with poor surface smoothness. For example, it is assumed that the printing operation will be carried out for a paper P by using an ink ribbon 400, as shown in FIG. 24. In FIG. 24, the ink ribbon 400 has a thermoplastic ink layer 410 of 5 μm thickness and micro capsules 420 of 20% in the thermoplastic ink layer 410. The paper P has an evenness of 30 to 50 degree, depths of the depression of 10 μm and a space factor of 40%. When it is assumed than the ink ribbon 400 has an ink volume of V in a prescribed pixel area, the micro capsule 420, with a volume of 0.2 V, can be entirely buried in the space of 0.2 V times portion of the thermoplastic ink layer 410 and the depression spaces of the paper P that has a volume of 0.8 V achieved by a calculation of $[(10/5)\times 0.4\times V=0.BV]$, thus resulting to the volume of V in total. When it is assumed that the micro capsules 420 has a volume expansion rate of 300%, the internal pressure of the micro capsules 420 is calculated as $0.2V\times 300\%\ /V=6$ arm. $=60$ g/mm$^2$, from the law of that gas pressure×volume=a constant. In a general thermal printing, line pressure is in the range of 150 to 200 g/cm and a nip width is about 2 mm, so that its printing pressure is in the range of 7.5 to 10 g/mm$^2$. Under these conditions, the pressure of 60 g/mm$^2$ achieved by the expansion of the micro capsules 420 exceeds by far the printing pressure of 7.5 to 10 g/mm$^2$, as in the general printing.

As a result, it is theoretically expected to achieve a sufficient quality of printed image from only the pressure according to the expansion of the micro capsules 420. However, in practical application it is needed to add a slight pressure on the thermal head against the ink ribbon 400 for securing good heat conduction. The pressure is preferred to be in the range of 20 to 150 g/mm$^2$, when considering that a line pressure of at least 20 to 50 g/cm is required, and also curvature of thermal line heads.

The separability of the thermoplastic ink layer 410 from the base film 450 is increased, because the contact area between them is reduced in the course of expansion of the micro capsules 420. As a result, a stable printed image (ink) is formed on the paper P so that a printing with high quality can be achieved. This is also obtained by using the ink ribbon 400 containing the intermediate layer 460 (see (FIGS. 11(*a*)-(*d*) and FIGS. 12(*a*)-(*d*).

If the color of the micro capsule 420 differs from that of the thermoplastic ink layer 410, it affects the color strength of the printed image, because the expanded micro capsules 420 expose the ink image printed on the paper P after the separation of the ink ribbon 400 from the paper P. For example, the micro capsules 420 are actually colorless and transparent, but they look white to the human eyes due to their size being so small. Thus the exposed micro capsules 420 reduce the color strength of the printed ink image in a general ink ribbon. In a worst case, the printed ink image looks gray even if the ink color is black. However, according to the embodiment of the ink ribbon 400, the micro capsules 420 are colored the same color as the thermoplastic ink layer 410, so that the color strength of the printed ink on the paper P is hardly reduced.

When the ink ribbon 400 is fed slower than the feed speed of the paper P for curtailing consumption of the ink ribbon down, the paper P and the thermoplastic ink layer 410 of the ink ribbon 400 rub together. As a result, there is a fear in general of fogging occurred on the non-recorded portion of the paper P. However, one embodiment of the ink ribbon 400 is provided with the colorless coating layer 470 on the thermoplastic ink layer 410. Thus, the embodiment of the ink ribbon 400 takes prevents such fogging on the paper.

Further in the embodiment of the ribbon 400 where the micro capsules 420 are exposed by the thermoplastic ink layer 410, the exposed portions of the micro capsules 420 can effectively reduce rubbing between the paper P and the thermoplastic ink layer 410. As a result, this embodiment of the ink ribbon 400 also takes the advantage of preventing such a fogging to be caused on the paper.

Now the principle of printing will be described in reference to FIGS. 16(*a*) to 16(*d*). FIGS. 16(*a*) to 16(*d*) are diagrammatical sections illustrating the flow of the printing operation carried out on a recording paper p by using the ink ribbon 400 and the thermal head 360. In the case of FIGS. 16(*a*) to 16(*d*), it is assumed that the ink ribbon 400 is fed at the speed of 0.5 times for the circumferential speed of the drum 100 (see FIGS. 2 to 5) for transporting the recording paper P, i.e., the feed speed of the recording paper P.

When the heating resistor 366 is turned ON, the heating resistor 366 generates Joule heat. Joule heat is conducted to the thermoplastic ink layer 410 through the base film 450 of the ink ribbon 400 (see FIG. 15 and FIG. 16(*a*)). The Joule heat melts the thermoplastic ink layer 410 and also expands the micro capsules 420 by increasing their volumes. According to the expansion of the micro capsules 420, the melted ink is pressed out from the ink ribbon 400 and then pressed against the depressed surface of the recording paper P (see FIG. 16(*b*)). Here an ink ribbon 400 is fed at the speed of 0.5 times the feed speed of the recording paper P, as assumed before. Thus the ink pressed out from the ink ribbon 400 is stretched on the paper P, after one line cycle period (see FIG. 16(*c*)). After a prescribed period of time, the ink on the portion bounded by the expanded capsules 420 is broken through flocculation, then a printed image pixel is formed on the recording paper P. On the other hand, the expanded micro capsules 420 almost remain on the ink ribbon 400 by an interruption of the unmelted portion of the thermoplastic ink layer 410 (see FIG. 16(*d*)).

The micro capsules 420 can be selectively expanded by dispersing micro capsules 420 with plural kinds of the expansion start temperature and controlling of the power applied to the thermal head 360. Then, the volume of the ink pressed out from the ink ribbon 400 (the volume of the ink on the recording paper P) can be controlled for achieving a tone controlled image by changing the expansion degree of the micro capsules 420.

Color Printing Mechanism:

Now the color printing mechanism will be described in detail in reference tip FIG. 17.

Figure 17:
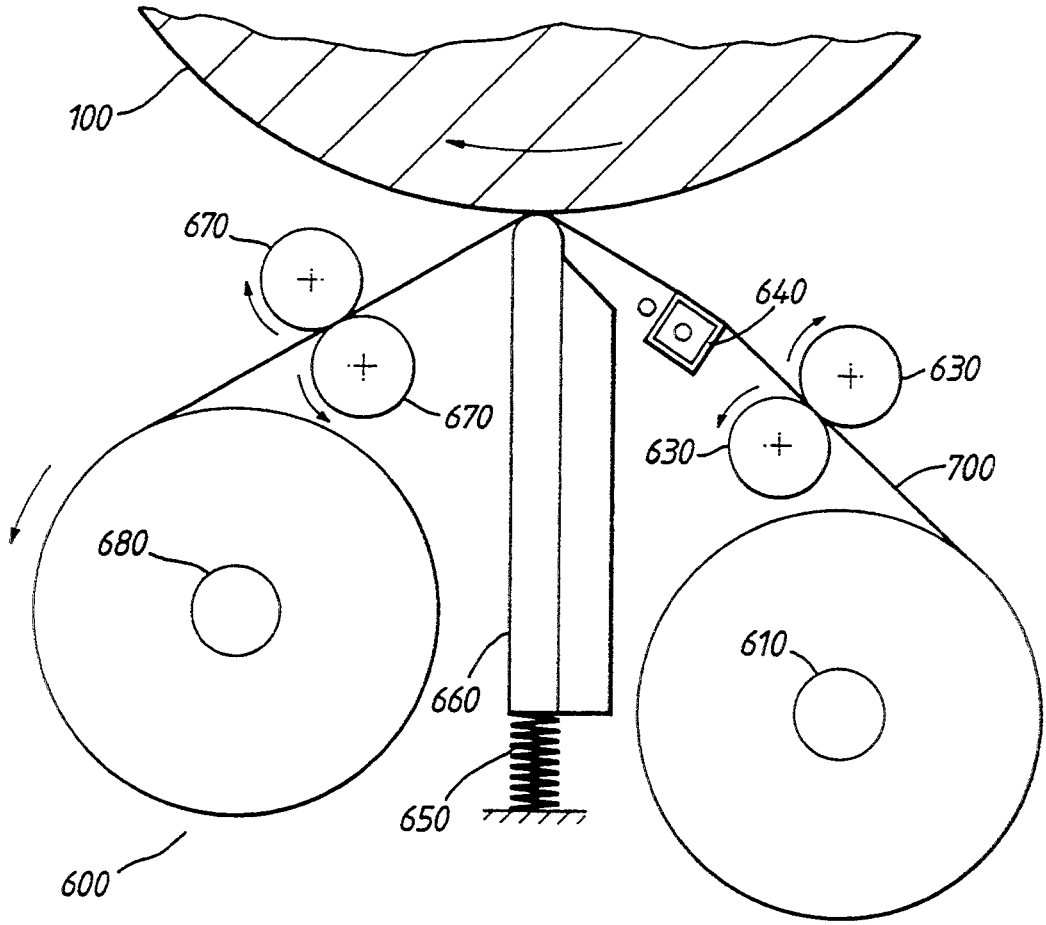
FIG. 17 is a sectional view showing the color printing mechanism 600.

FIG. 17 is a sectional view of the color printing mechanism 600. This color printing mechanism 600 has a construction almost the same as the monochrome printing mechanism 300 (see FIG. 2), except that this color printing mechanism 600 is not adapted to curtailing consumption of the ink ribbon.

One end of a colored ink ribbon 700 is wound on a supply reel 610, clamped between a pair of supply drive rollers 630 and 630, kept in contact with a preheater 640, clamped between a thermal head 660 compressed by a compressed coil spring 650 and the drum 100 and a pair of take-up drive rollers 670 and 670. The other end of the colored ink ribbon 700 is taken up on a take-up reel 680.

A pair of supply drive rollers 630 and 630 is directly coupled to and driven by a motor (not shown) rotating faster than a regular speed for applying a fixed tension to the colored ink ribbon 700. A pair of take-up drive rollers 670 and 670 and the take-up reel 680 are driven by way of a sliding clutch, not shown.

The transporting speeds of these colored ink ribbon transporting sections are regulated by the pair of supply drive rollers 630 and 630.

Further, the transporting speed of a pair of the supply drive rollers 630 and 630 which controls the transporting speed of the colored ink ribbon 700 is set at 0.1 to 0.9 times the peripheral speed of the drum 100, but it is especially preferable to set it in the range 0.2 to 0.5 times the peripheral speed of the drum 100.

The compression coil spring 650 compresses the thermal head 660 against the drum 100 at less pressure than normal pressure and the pressure is set at 20 to 150 g/cm but it is especially desirable to set it in the range of 50 to 100 g/cm.

The preheater 640 and the thermal head 660 are identical to those as used in the monochrome printing mechanism 300 (see FIG. 2). Thus, the detailed description of the preheater 640 and the thermal head 660 will be omitted. The principle of the color printing is identical to that of the monochrome printing so that it will be also omitted.

Figure 18:
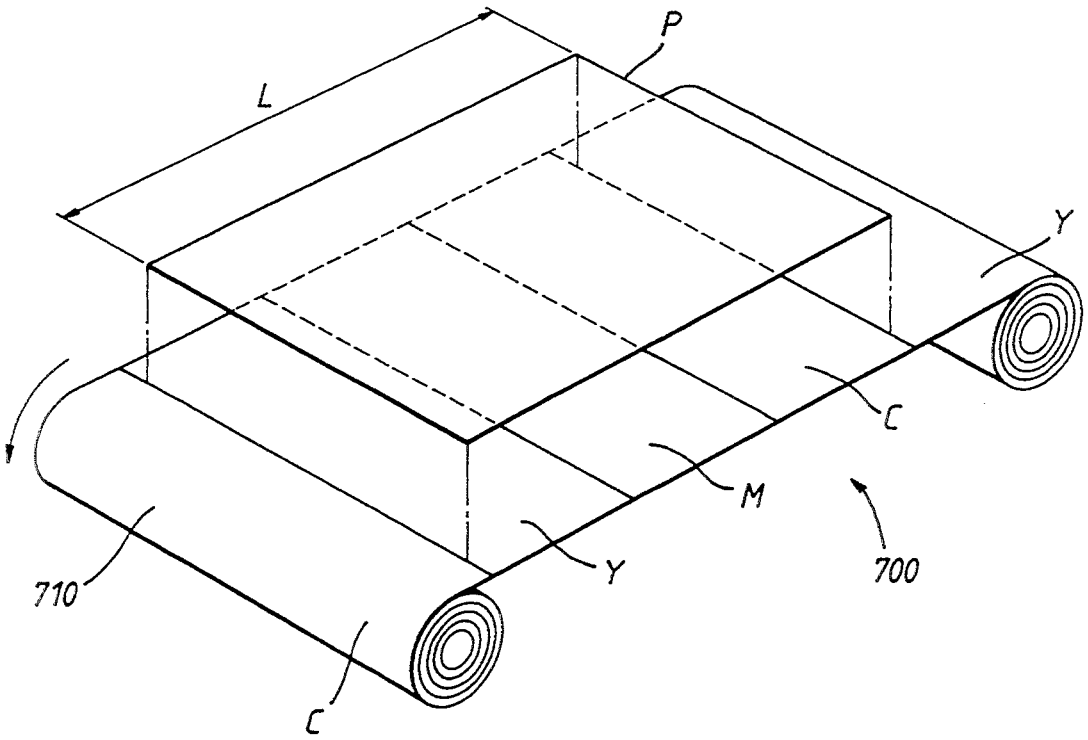
FIG. 18 is a sectional view showing the construction of the colored ink ribbon 700.

Colored Ink Ribbon:

Shown in FIG. 18 is a sectional view depicting the construction of the colored ink ribbon 700.

As shown in FIG. 18, the colored ink ribbon 700 is divisionally coated with three types of thermoplastic ink layers with three colors. In this embodiment, thermoplastic ink layers with yellow Y, magenta M and cyane C are repeatedly coated on the base film in the turn along the sub scanning direction, i.e., in the running direction of the colored ink ribbon 700. The length of a set of three colored ink layers Y, M, C are set to be equal to the length of a recording paper P. In this case, the colored ink ribbon 700 is transported at a speed 0.33 times of the speed of the transporting speed of the paper P.

Figure 19:
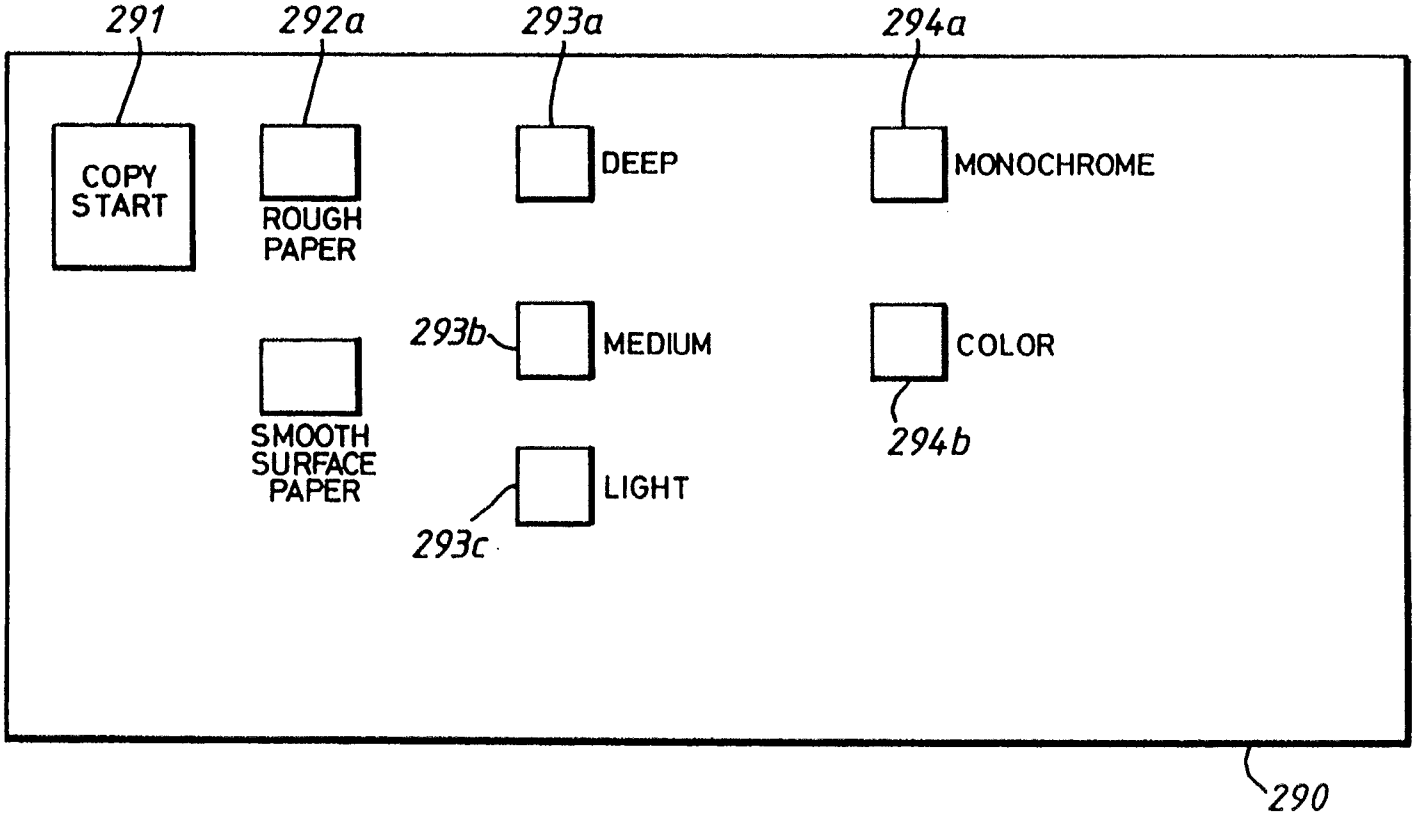
FIG. 19 is a plan view showing the construction of the control panel 290.

Control Panel:

Now a control panel 290 will be described in reference to FIG. 19. FIG. 19 is a plan view showing the construction of the control panel 290.

As shown in FIG. 19, the control panel 290 includes a copy key 291, a set of paper quality selection keys **292*a* and 292*b*, a set of printing density selection keys 293*a*, 293*b* and 293*c*, a set: of monochrome and color printing selection keys 294*a* and 294*b*. The paper quality selection keys 292*a* and 292*b* are designated for selecting a recording paper between a paper with a relatively rough surface and a paper with a relatively smooth surface, respectively. The printing density selection keys 293*a*, 293*b* and 293*c* are designated for selecting a printing density among three steps of different densities. The monochrome and color printing selection keys 294*a* and 294*b* are designated for changing the printing operation between the monochrome printing and the color printing. While, the copy key 291** starts the printing operation.

The paper quality selection key **292*a* is used for printing on a rough surface paper with a surface smoothness less than 200 sec. in the Beck's smoothness criteria, e.g., "PPC" paper regularly used for copying machines and printers, a bond paper regularly used in Europe and the U.S.A., etc. The other paper quality selection key 292*b*** is used for printing on a smooth surface paper with the surface smoothness not less than 200 sec. in Beck's smoothness standards, e.g., regular thermal print paper, special thermal printing paper provided with a smooth layer on a base paper a polypropylene sheet, or a PET (polyethylene-terephthalate) film regularly used for an OHP (over head projector) device.

Figure 20:
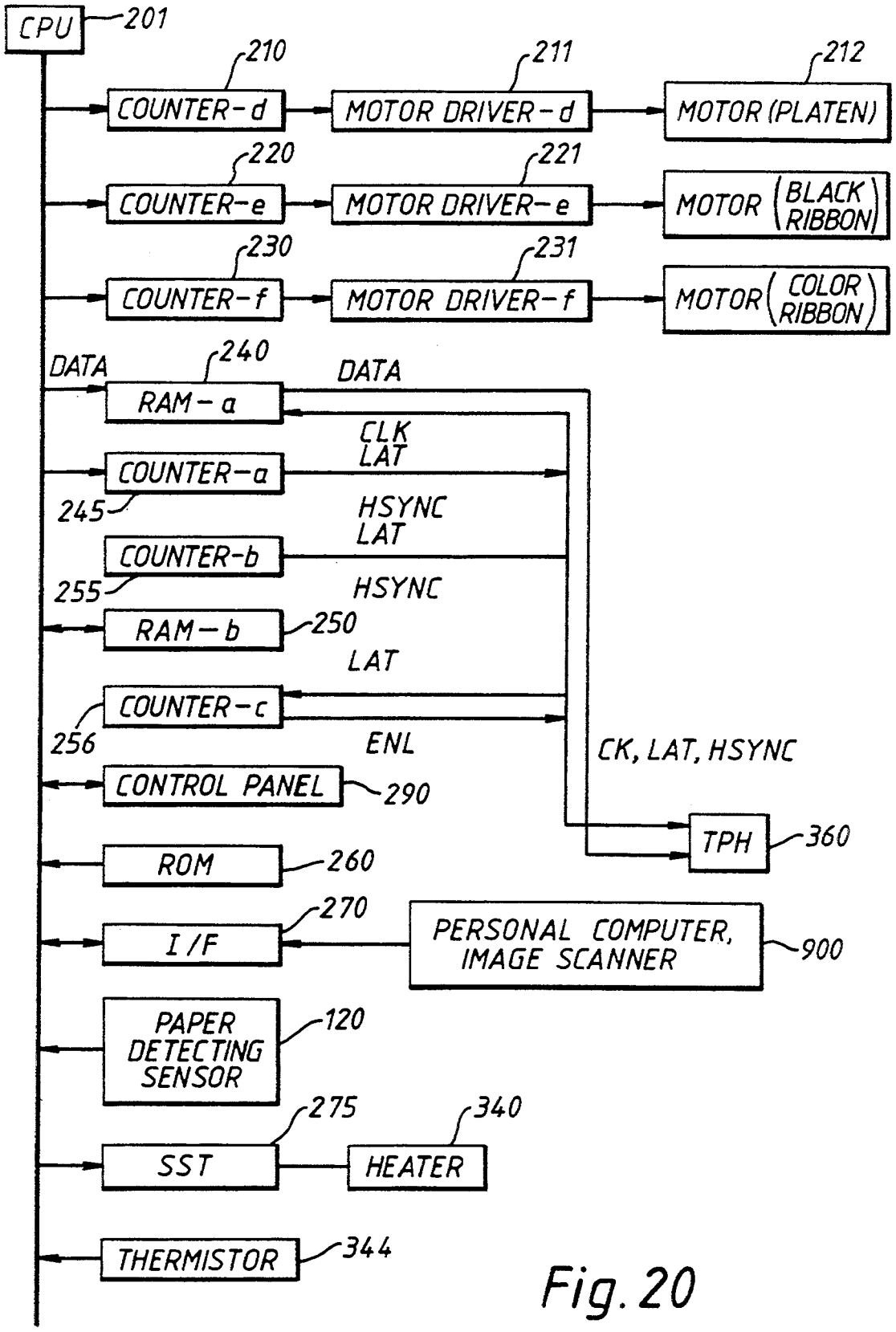
FIG. 20 is a block diagram showing the controller circuit.
Figure 21:
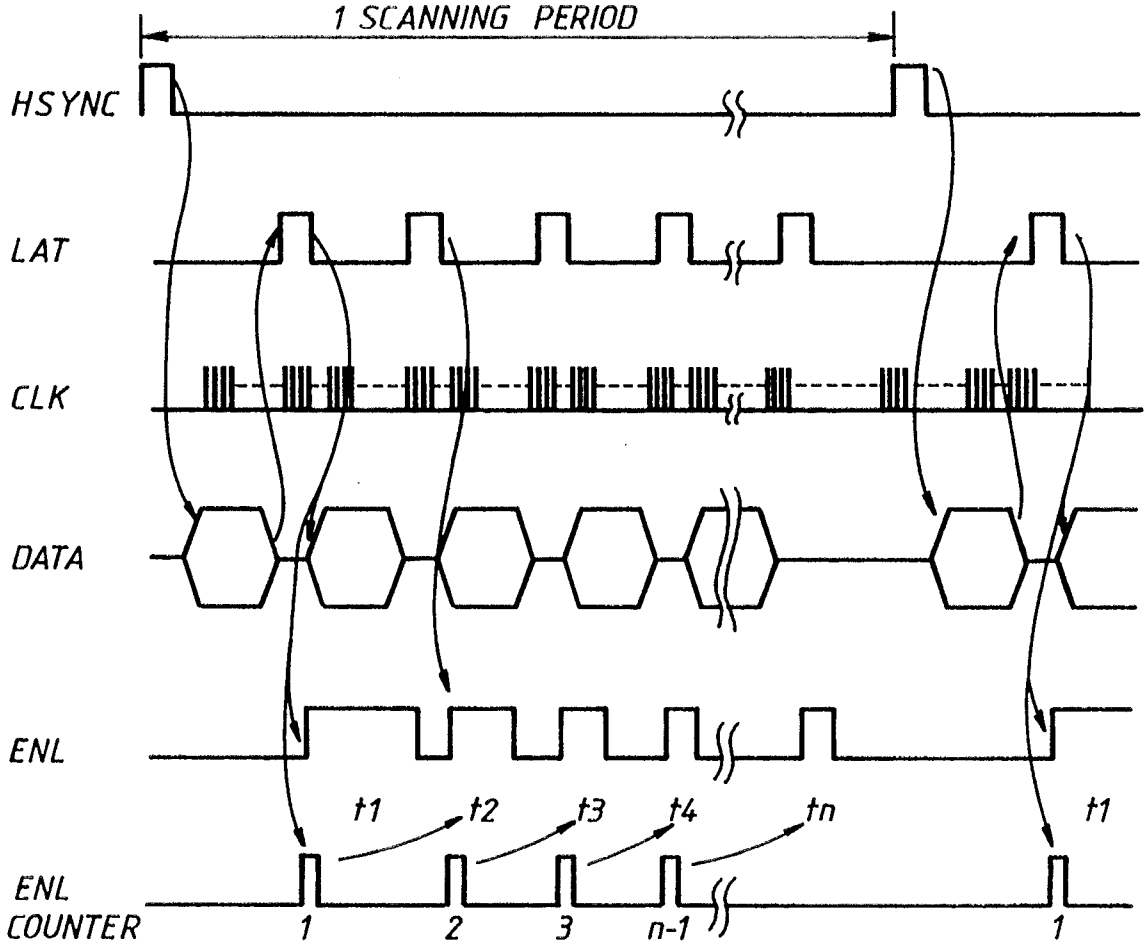
FIG. 21 is a timing chart showing signals processed in the controlling circuit of FIG. 20 and their timing relations.

Controller Circuit:

Referring now to FIGS. 20 and 21, a controller circuit employed in the image forming apparatus and its operation will be described. FIG. 20 is a block diagram showing the controller circuit. FIG. 21 is a timing chart showing signals processed in the controlling circuit of FIG. 20 and their timing relations.

In FIG. 20, a RAM-a 240 stores input and output image data. ROM 260 stores a program for controlling the operation of the image forming apparatus. A RAM-b 250 stores enabling signals ENL which correspond to a variety of information applied from the paper quality selection keys **292*a* and 292*b*, the printing density selection keys 293*a*, 293*b* and 293*c* on the control panel 290**.

A counter-a 245 generates a set signal for controlling the thermal head 360, e.g., a horizontal sync. signal HSYNC which is output for every scanning line, a latch signal LAT and a clock signal CLK.

A counter-b 255 generates an address for reading out the data of the enabling signal ENL stored in the RAM-b 255.

A counter-c 256 generates an enabling signal ENL lasting for a time period corresponding to the enabling signal ENL read out from the RAM-a 250 as a one-shot pulse.

A counter-d 210 has been previously set to a prescribed value by the ROM 260, then the counter-d 210 generates pulses for applying a motor driver-d 211 at a prescribed period. The motor driver-d 211 generates exciting fields for controlling a pulse motor (platen) 212 for driving the drum 100.

Similarly, a counter-e **220*a* and a counter-f 230 have been previously set to respectively prescribed values by the ROM 260, then the counter-e 220 and the counter-f 230 generate pulses for applying a motor driver-e 221 and a motor driver-f 231 at respectively prescribed periods. The motor driver-e 221 generates exciting fields for controlling a pulse motor (monochrome ribbon) 222 for driving the monochrome ink ribbon 400. While, motor driver-f 231 generates exciting fields for controlling a pulse motor (colored ribbon) 222 for driving the colored ink ribbon 700**.

The preheater 340 is used for preheating the ink ribbon 400. The surface temperature of the preheater 340 is measured by a thermistor 344, so that a SST 275 coupled to the preheater 340 is turned ON or OFF for maintaining the surface temperature of the preheater 340 at a previously set temperature.

A block 120 represents a paper detection sensor for detecting a position of the paper P transported in the apparatus. A block 201 represents a CPU for controlling the whole portion of the apparatus. A block 270 represents an interface for receiving image data from an external device such as a scanner, a personal computer, etc.

Now the operation of the apparatus will be described in reference to FIG. 21.

a) Under control of the CPU 201, the horizontal sync. signal HSYNC representing an end of the scanning line is output from the counter-a 245 and then applied to the RAM-a 255 and the counter-b 255.

b) In response to the horizontal sync. signal HSYNC, an image data DATA is applied from the RAM-a 240 to the thermal head 360 in synchronization with the clock signal CLK. At this time, a prescribed address is applied from the counter-b 255 to the RAM-b 250, so that data corresponding to the address, i.e., data for setting an effective timing period of the enabling signal ENL (referred to as ENL period setting data hereafter) is transferred to the counter-c 256.

c) When the image data DATA for the effective image pixels of the thermal head 360 are completely transferred, the latch signal LAT is output from the counter-a 245 to the thermal head 360.

d) Following the latch signal LAT, the enabling signal ENL is output from the counter-c 256 to the thermal head 360. This enabling signal ENTL has an effective period which is defined in response to the data transferred from the RAM-b 250 to the counter-c 256. The printing operation for the paper P is carried in the effective period (H level period represented by t1). Simultaneously, an address which is incremented by one to the prior address is supplied from the RAM-b 250. Then a data (ENL period setting data) corresponding to this incremented address is transferred to the counter-c 256.

The above-described operations, i.e., the translation of the image data, the output of the latch signal LAT, supplying the enabling signal ENL, translation of the ENL period setting data, are repeated for a prescribed time. Thus, the horizontal sync. signals HSYNC are successively output to complete the image forming operation. The address supplied from the counter-b 255 to the RAM-b 250 is restored to its original set value in response to the horizontal sync. signal HSYNC.

The ENL period setting data can be voluntarily set by altering data to be written into the RAM-b 250.

In the case where a color recording is selected by color printing selection key **294*b*, the above-described operation is repeated for the image pixels in the subscanning direction as to a specified colored ink selected from yellow ink Y, magenta ink M and cyane ink C formed on the colored ink ribbon 700 and black ink Bk of the monochrome ink ribbon 300, so that an image colored by the specific colored ink is formed on the paper P. The paper detection sensor 120 detects the end of the paper P for synchronizing the repeated supply of paper P with each of the colored inks. Then respective colored images are properly registered to each other. In the case where a monochrome recording is selected by the monochrome printing selection key 294**a, the recording operation is carried out on only the black ink Bk.

Figure 22:
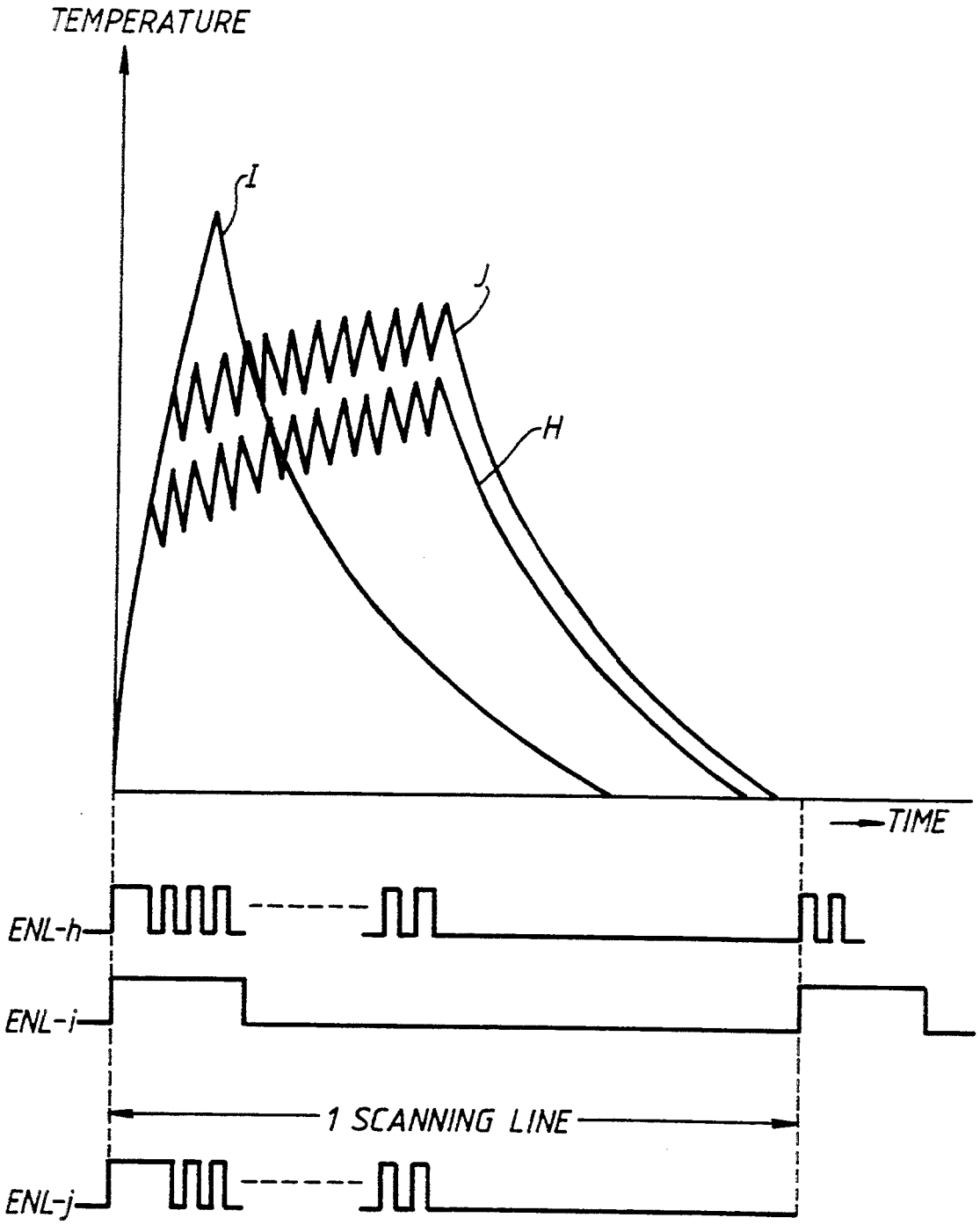
FIG. 22 is a graph illustrating the temperature transitions of the heating resistor 366 of the thermal head 360 in the one cycle period of the scanning line.

FIG. 22 is a graph illustrating the temperature transitions of the heating resistor 366 of the thermal head 360 for one cycle period of the scanning line. In FIG. 22, H shows the temperature transition according to the present invention. Line I shows a temperature transition according to conventional image forming, wherein enabling signal ENL-i with one shot of a relatively high level pulse is applied to the heating resistor 366.

In the conventional image forming manner, it was difficult to extend the ENL period over a prescribed period, because the temperature of the heating resistor 366 was excessively raised to cause the heating resistor 366 to be easily damaged as well as to have its life shortened.

In the present invention, however, the enabling signal ENL-h contains a plurality of pulses for a prescribed range in the scanning period. This shape of enabling signal ENL-h is able to maintain the heating resistor 366 within a proper range of the temperature for a long time of period. Thus the micro capsules 420 (720) in the ink ribbon 400 (700) are completely expanded by the enabling signal ENL-h.

Further, the first pulse corresponding to the first address has a pulse width wider than the following pulses. Accordingly, the first pulse can cause an amount of heat greater than those caused by the other pulses in the heating resistor 366, so that the temperature of the heating resistor 366 can reach a desired temperature within a short time. That is, a splendid rise characteristic is achieved for generating heat in the heating resistor 366.

In FIG. 22, Line J shows another temperature transition according to the present invention. This temperature transition characteristic J is achieved by another enabling signal ENL-J in which the first pulse has a pulse width longer than that of the enabling signal ENL-h. As seen from the lines H and J, the temperature range of the heating resistor 366 is easily adjusted to a desired range. This is advantageous for selectively expanding desired micro capsules 420 (720) within a variety of micro capsules with different expansion start temperatures. Thus, the total volume of the expanded micro capsules 420 is controlled for adjusting the amount of ink to be adhered on the paper P to the purpose of the toned image recording.

In the case where the paper quality selection key **292*a* is selected for recording image on a rough surface paper P, an enabling signal ENL with a relatively long period of time such as the enabling signal ENL-j. Then the heating resistor 366 is maintained at a temperature sufficient for completely expanding the micro capsules 420. As a result, the melted ink on the ink ribbon 400 (700) is securely adhered onto the rough surface of the paper P. On the other hand, when the other paper quality selection key 292*b* is selected for recording image on a smooth surface paper P, an enabling signal ENL with a relatively short period of time such as the enabling signal ENL-h is used. Then, the heating resistor 366 is maintained at a temperature insufficient for completely expanding the micro capsules 420, but capable of melting the binders in the thermoplastic ink layer 410. As a result, the melted ink on the ink ribbon 400 (700) is adhered on to the smooth surface of the paper P at a proper pressure. This is advantageous for expanding the life of the heating resistor 366 of the thermal 360, as well as for reducing the power to be supplied to the thermal head 360**.

As described above, the present invention can provide an extremely preferable image forming apparatus. That is, the image forming apparatus according to the present invention has many advantages, such as reduction of the platen pressure, reduction of the size of the apparatus, suppression of jitter, prevention of wrinkles in the ink ribbon, expansion of the life of the thermal head. Further, the present invention can advantageously reduce consumption of ink ribbon by transporting the ink ribbon slower than the feed speed of the paper, without a fear of causing a degradation of recorded images, such as the fogging. The present invention also has a merit of reducing the consumption of the colored ink ribbon in the case of a color printing operation.

While there have been illustrated and described what are at present considered to be preferred embodiments of the present invention, it will be understood by those skilled in the art that various changes and modifications my be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. An image forming apparatus for transferring an image onto a recording medium, said apparatus comprising:

a thermoplastic transfer medium including a thermoplastic ink layer, thermally expansible particles, and a base for carrying the thermoplastic ink layer and the thermally expansible particles, the thermally expansible particles having a diameter greater than the thickness of the thermoplastic ink layer;

heating means for selectively heating the thermoplastic ink layer and the thermally expansible particles, the thermally expansible particles having a melting point higher than the melting point of the thermoplastic ink layer, so as to transfer the thermoplastic ink layer and the thermally expansible particles onto the recording medium when each has reached its respective melting point;

means for selecting one of (1) a first recording mode for forming images on the recording medium using the thermoplastic ink layer in a melted state on a smoothly surfaced recording medium, and (2) a second recording mode for forming images on a roughly surfaced recording medium, the images formed in the second recording mode being of the same color as the images formed in the first recording mode, the second recording mode using both the melted thermoplastic ink layer and the melted thermally expansible particles mixed together; and means for controlling the heating means to melt the thermoplastic ink layer by heating it to its melting point when the first recording mode is selected, and by heating the thermally expansible particles to their melting point, so that both the thermoplastic ink layer and the thermally expansible particles are melted when the second recording mode is selected.

2. The image forming apparatus of claim 1, wherein the thermally expansible particles are embedded in the thermoplastic ink layer.

3. An image forming apparatus for transferring an image onto a recording medium, said apparatus comprising:

a thermoplastic transfer medium, including a thermoplastic agent and thermally expansible particles;

means for selectively heating the thermoplastic transfer medium to the melting point of either the thermoplastic agent or the thermally expansible particles, the thermoplastic agent melting at a temperature lower than the melting point temperature of the thermally expansible particles, the thermoplastic agent and the thermally expansible particles being of the same color, the thermoplastic agent and the thermally expansible particles each being transferrable, upon reaching its respective melting point, onto the recording medium;

selecting means for selecting one of (1) a first recording mode for forming images on the recording medium using the thermoplastic agent in the melted state, and (2) a second recording mode for forming images on the recording medium of the same color as images formed by the first recording mode using both the thermoplastic agent and the thermally expansible particles in their melted states, the first mode being selected when the recording medium has a smooth surface and the second mode being selected when the recording medium has a rough surface; and means for controlling said heating means to heat the thermoplastic transfer medium to a first temperature for melting the thermoplastic agent when the first recording mode is selected, and heating the thermally expansible particles to their melting point when the second mode is selected, the higher temperature melting both the thermoplastic agent and the thermally expansible particles.

4. The image forming apparatus of claim 3, wherein the thermally expansible particles have a diameter greater than the thickness of the thermoplastic agent.

5. The image forming apparatus of claim 3, wherein the thermally expansible particles have a diameter less than the thickness of the thermoplastic agent.

6. The image forming apparatus of claim 3, wherein the thermally expansible particles are embedded in the thermoplastic agent.

7. An image forming apparatus as claimed in claim 3, further comprising:

means for applying heating energy to the heating means in response to an electrical signal containing a plurality of pulses.

8. An image forming apparatus as claimed in claim 3, further comprising:

means for preheating the thermoplastic transfer medium before the thermoplastic transfer medium is heated by the image transfer means.

9. An image forming apparatus as claimed in claim 3, further comprising:

a first transporting means for transporting the recording medium at a first speed along a predetermined path;

a second transporting means for transporting the thermoplastic transfer medium at a second speed along the predetermined path; and speed control means for controlling the second speed of the thermoplastic transfer medium to be slower than the first speed of the recording medium at the position along the predetermined path where a transfer of images occurs.

10. An image forming apparatus as claimed in claim 9, further comprising:

means for applying heating energy in response to an electrical signal containing a plurality of pulses to the heating means.

11. An image forming apparatus as claimed in claim 9, further comprising:

means for preheating the thermoplastic transfer medium before the thermoplastic transfer medium is heated by the image transfer means.

* * * * *